US011369891B2

(12) United States Patent
Furuike et al.

(10) Patent No.: US 11,369,891 B2
(45) Date of Patent: Jun. 28, 2022

(54) WALKING TOY

(71) Applicant: NINTENDO CO., LTD., Kyoto (JP)

(72) Inventors: Hironori Furuike, Kyoto (JP); Toshiaki Iwao, Kyoto (JP); Kazuhiko Koriyama, Kyoto (JP); Yasuhisa Kitano, Kyoto (JP); Takaki Fujino, Kyoto (JP); Keizo Ota, Kyoto (JP)

(73) Assignee: Nintendo Co., Ltd., Kyoto (JP)

( * ) Notice: Subject to any disclaimer, the term of this patent is extended or adjusted under 35 U.S.C. 154(b) by 0 days.

(21) Appl. No.: 17/213,865

(22) Filed: Mar. 26, 2021

(65) Prior Publication Data

US 2021/0316226 A1 Oct. 14, 2021

(30) Foreign Application Priority Data

Apr. 9, 2020 (JP) ..... JP2020-070506

(51) Int. Cl.
*A63H 11/18* (2006.01)
*A63H 31/08* (2006.01)

(52) U.S. Cl.
CPC ..... *A63H 11/18* (2013.01); *A63H 31/08* (2013.01)

(58) Field of Classification Search
CPC ..... A63H 11/18
See application file for complete search history.

(56) References Cited

U.S. PATENT DOCUMENTS 1,986,446 A * 1/1935 Powleson ..... A63H 11/18 446/390
2,667,719 A 2/1954 Edwardson
3,665,644 A * 5/1972 Rapp ..... A63H 11/18 446/355

(Continued)

FOREIGN PATENT DOCUMENTS

CA 852443 9/1970
JP 07-31749 2/1995

(Continued)

OTHER PUBLICATIONS

Extended European Search Report dated Sep. 2, 2021 in corresponding European Application No. 21162045.5, 6 pages.

(Continued)

*Primary Examiner* — John A Ricci
(74) *Attorney, Agent, or Firm* — Nixon & Vanderhye PC

(57) ABSTRACT

A walking toy in which if a torso is moved forward walking motion is performed has the torso, two legs. The walking toy includes a crank member having a pair of crank eccentric shafts. Each of the legs has a motion member giving rotational force to the crank member when the torso moves forward. Each of the motion members has an eccentric shaft connecting part pivotably connected to the corresponding crank eccentric shaft, a torso cooperation part, and an action part on which force received from the walking surface act. Projections are formed at the torso cooperation part, while grooves are formed at the torso. If the action part of the one leg moves rearward, the motion member moves to thereby (Continued)

impart rotational force to the crank member and, the other leg is moved forward due to rotation of the crank member, and then contacts the walking surface.

20 Claims, 25 Drawing Sheets

(56) References Cited

U.S. PATENT DOCUMENTS

| | | | | | |
|---|---|---|---|---|---|
| 4,878,874 | A * | 11/1989 | Terzian | A63H 11/18 | 446/276 |
| 6,146,235 | A * | 11/2000 | Migliorati | A63H 11/18 | 446/377 |
| 6,149,491 | A * | 11/2000 | Arad | A63H 3/48 | 446/175 |
| 8,500,512 | B2 * | 8/2013 | Hoeting | A63H 11/18 | 446/354 |
| 2001/0033145 | A1 | 10/2001 | Filo | | |

FOREIGN PATENT DOCUMENTS

| | | |
|---|---|---|
| JP | 2001-129268 | 5/2001 |
| JP | 2003-260274 | 9/2003 |
| JP | 2015-134125 | 7/2015 |
| WO | 2017/212899 | 12/2017 |

OTHER PUBLICATIONS

Decision to Grant dated Sep. 9, 2021 in corresponding Japanese Application No. 2020-070506, 3 pages.

* cited by examiner

WALKING TOY

CROSS REFERENCE TO RELATED APPLICATION

The present application claims priority to Japanese Patent Application No. 2020-070506 filed on Apr. 9, 2020, which is incorporated herein by reference in its entirety including the specifications, drawings and abstract.

FIELD

The present disclosure relates to a walking toy.

BACKGROUND

A walking toy having a torso and two legs connected to the torso and walking by the legs when making the torso move forward in the state with the bottom end surface of at least one leg contacting the ground, floor, or other walking surface, has been studied (for example, WO2017/212899). In such a walking toy, when making the torso move forward to move the one leg contacting the walking surface relatively rearward, a crank member rotates and, due to the rotation of the crank member, the other leg is moved forward in the state separated from the walking surface. By such an operation being continuously performed, the walking toy walks by its legs.

In this regard, in one aspect, in one mechanism of the walking toy described in WO2017/212899, a large number of links are provided, therefore the structure thereof is complicated and the number of parts thereof is large. Further, in another aspect, in another mechanism of the walking toy described in WO2017/212899, when making one leg move relatively rearward, sometimes the crank member has difficulty in rotating along with the movement, and accordingly there is a possibility of stable walking of the walking toy sometimes being difficult to be kept continuing. In this way, there is room for improvement of the walking mechanism of the walking toy described in WO2017/212899.

SUMMARY

The gist of the present disclosure is as follows:

(1) A walking toy having: an upper body part including a torso; and two legs connected to the torso, in which if the torso is made to move forward in the state where a contact surface of at least one leg contacts a walking surface, walking motion is performed by the legs, the walking toy comprising:

a crank member rotatably supported in the torso and having a pair of crank eccentric shafts positioned eccentrically from a rotational axis of the crank member, wherein the crank eccentric shafts are arranged so as to have opposite phases from each other with respect to the rotational axis, each of the legs has a motion member giving rotational force to the crank member when the torso moves forward, each of the motion members has an eccentric shaft connecting part pivotably connected to the corresponding crank eccentric shaft, a torso cooperation part cooperating with the torso, and an action part on which force received from the walking surface act, grooves are formed at one of the torso cooperation parts of the motion members and the torso, and projections sliding in the grooves and guided by the grooves are formed at the other of the torso cooperation parts and the torso, the grooves are configured so that the projections can reciprocate in the grooves corresponding to rotational motion of the crank member, and if the torso is made to move forward to make the action part of the motion member of the one leg contacting the walking surface move rearward relative to the torso, the motion member of the one leg moves to thereby impart rotational force to the crank member by the motion member due to the projection being limited in movement in the groove and, the other leg is made to move forward in the state separated from the walking surface due to rotation of the crank member and then is made to contact the walking surface.

(2) A walking toy having: an upper body part including a torso: and two legs connected to the torso, in which if the torso is made to move forward in the state where a contact surface of at least one leg contacts a walking surface, walking motion is performed by the legs, the walking toy comprising:

a crank member rotatably supported in the torso and having a pair of crank eccentric shafts positioned eccentrically from a rotational axis of the crank member, wherein the crank eccentric shafts are arranged so as to have opposite phases from each other with respect to the rotational axis, each of the legs has a motion member giving rotational force to the crank member when the torso moves forward, each of the motion members has an eccentric shaft connecting parts pivotably connected to the corresponding crank eccentric shafts, a torso cooperation parts cooperating with the torso, and an action part on which force received from the walking surface act, support point mechanisms making the torso cooperation parts of the motion members function as points of support in the motion members are formed at the torso cooperation parts of the motion members and the torso, and if the torso is made to move forward to make the action part of the motion member of the one leg contacting the walking surface move rearward relative to the torso, the motion member of the one leg is pivoted using the upper part of that motion member as a point of support, and a rotational force is applied to the crank member by the motion member of the pivoting one leg and, the other leg is made to move forward in the state separated from the walking surface due to rotation of the crank member and then is made to contact the walking surface.

(3) The walking toy according to the above (2), wherein the support point mechanisms include guide mechanisms guiding the torso cooperation parts of the motion members with respect to the torso.

(4) A walking toy having: an upper body part including a torso: and two legs connected to the torso, in which if the torso is made to move forward in the state where a contact surface of at least one leg contacts a walking surface, walking motion is performed by the legs, the walking toy comprising:

a crank member rotatably supported in the torso and having a pair of crank eccentric shafts positioned eccentrically from a rotational axis of the crank member, wherein the crank eccentric shafts are arranged so as to have opposite phases from each other with respect to the rotational axis, each of the legs has a motion member giving rotational force to the crank member when the torso moves forward, each of the motion members has an eccentric shaft connecting part pivotably connected to the corresponding crank eccentric shafts, a torso cooperation parts cooperating with the torso, and an action part on which force received from the walking surface act, movement limiting mechanisms limiting the range by which the torso cooperation parts of the motion members can move with respect to the torso are formed at the torso cooperation parts of the motion members and the torso, and if the torso is made to move forward to make the action part of the motion member of the one leg contacting the walking surface move rearward relative to the torso, the motion member of the one leg moves to apply rotational force to the crank member by the motion member due to the range of possible movement of the torso cooperation part being limited by the movement limiting mechanism, and, the other leg is made to move forward in a state separated from the walking surface due to rotation of the crank member and then contacts the walking surface.

(5) The walking toy according to the above (4), wherein the movement limiting mechanisms include guide mechanisms guiding the torso cooperation parts with respect to the torso.

(6) The walking toy according to the above (3) or (5), wherein the guide mechanisms guide the torso cooperation parts with respect to the torso in a direction where the torso forms an angle with respect to the walking surface when the torso is in a state standing upright with respect to the walking surface.

(7) The walking toy according to any one of the above (3), (5), and (6), wherein the guide mechanisms have grooves provided at one of the torso cooperation parts and the torso, and projections provided at the other of the torso cooperation parts and the torso, and the projections slide in the grooves whereby the torso cooperation parts are guided with respect to the torso.

(8) The walking toy according to any one of the above (1) to (7), wherein the action parts of the motion members contact the walking surface when the legs having the motion members contact the walking surface.

(9) The walking toy according to any one of the above (1) to (7), wherein each of the legs further has an upper leg member and a lower leg member, the upper part of the upper leg member is pivotably connected to the torso and the lower leg member is pivotably connected to a lower part of the upper leg member, and the action part of each of the motion members is connected to the corresponding lower leg member at a position different from the connecting part to the upper leg members.

(10) The walking toy according to the above (9), wherein the action part of each of the motion members is pivotably connected to the corresponding lower leg member at a positions rearward from the connecting part to the upper leg members.

(11) The walking toy according to any one of the above (1) to (10), wherein the motion members are straight rods, and the eccentric shaft connecting part is positioned between the torso cooperation part and the action part.

(12) The walking toy according to any one of the above (1) to (11), wherein the contact surface of each of the legs is formed in an arc shape sticking out toward the walking surface in the front-rear direction.

(13) The walking toy according to any one of the above (1) to (12), wherein the walking toy further comprises a walking aid attached to the upper body part, and the walking aid has an auxiliary contact part continuously contacting the walking surface at a position different from the legs while the walking motion is being performed.

(14) The walking toy according to the above (13), wherein the auxiliary contact parts are wheels.

(15) The walking toy according to the above (14), wherein the wheels rotate about a single axis substantially perpendicular to the front-rear direction.

(16) The walking toy according to the above (14) or (15), wherein the walking aid has a motor driving the wheels.

(17) The walking toy according to any one of the above (13) to (16), wherein the walking aid is attached to the rear side of the upper body part.

(18) The walking toy according to any one of the above (13) to (17), wherein the walking aid is attached to the upper body part so that a forward and downward force are applied to the upper body part when a forward and downward force are applied to the walking aid.

(19) The walking toy according to the above (18), wherein the walking aid has a main body part having auxiliary contact parts, and an arm fixed to the main body part at one of the end parts and attached to the rear side of the upper body part at the other end part, and the arm is attached to the upper body part so as to be slanted upward from a position fixed to the main body part toward a position attached to the upper body part.

(20) The walking toy according to any one of the above (13) to (19), wherein the torso, the legs, and the crank member are configured so that the walking motion is continuously performed when the angle, in the front-rear direction, of the axis of the torso with respect to the walking surface is within a certain range, and the walking aid holds the torso so that the angle of the axis of the torso with respect to the walking surface is maintained within the certain range.

(21) The walking toy according to any one of the above (13) to (19), wherein the torso, the legs, and the crank member are configured so that the lower leg member of the other leg which had been moved forward in a state separated from the walking surface contacts the ground after reaching the forward most position, if the angle, in the front-rear direction, of the axis of the torso with respect to the walking surface is within a certain range, and the walking aid holds the torso so that the angle of the axis of the torso with respect to the walking surface is maintained within the certain range.

(22) The walking toy according to any one of the above (13) to (21), wherein the walking aid has an attachment part and the upper body part has a receiving part, and the walking aid is detachably attached with respect to the upper body part by the attachment part being detachably attached with respect to the receiving part.

(23) The walking toy according to any one of the above (1) to (22), further comprising a phase detector detecting a rotational phase of the crank member.

(24) The walking toy according to the above (23), wherein the phase detector has a detected part provided at the crank member, and a detector arranged so as to face the detected part, the detected part is formed so that an outer circumferential surface thereof changes in distance from the rotational axis of the crank member in the circumferential direction of the crank member, the detector outputs a signal corresponding to the distance to the outer circumferential surface of the detected part.

(25) The walking toy according to the above (22), further comprising a phase detector detecting a rotational phase of the crank member, wherein the phase detector has a detected part provided at the crank member and a detector arranged at the attachment part so as to face the detected part, the detected part is formed so that an outer circumferential surface thereof changes in distance from the rotational axis of the crank member in the circumferential direction of the crank member, and the detector outputs a signal corresponding to the distance to the outer circumferential surface of the detected part.

(26) The walking toy according to the above (25), wherein the detector is an optical sensor detecting a distance to an object, the receiving part is a receiving hole formed in the torso, the attachment part is configured so as to be inserted in the receiving hole, and the detector is arranged at the attachment part so that the detector faces the detected part in the torso when the attachment part is inserted into the receiving part.

(27) The walking toy according to the above (25) or (26), wherein the attachment part is positioned upward from the detected part when attached to the receiving part, and the detector is arranged at the bottom side of the attachment part so as to face the top surface of the detected part when the attachment part is attached to the receiving part.

(28) The walking toy according to any one of the above (24) to (27), wherein the crank member has a spacer arranged in a rotational axis direction of the detected part and the spacer has an outer circumferential shape different from the detected part, and the torso is formed so that the torso does not interfere with either outer circumferential surface of the detected part or the spacer when the crank member is arranged in the torso in a first direction, and so that the torso interferes with either outer circumferential surface of the detected part or the spacer when the crank member is arranged in the torso in a second direction opposite to the first direction.

(29) The walking toy according to any one of the above (23) to (28), further comprising a computer to which a signal output from the phase detector is input and performing processing according to the input signal.

BRIEF DESCRIPTION OF DRAWINGS

Embodiments of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DESCRIPTION OF EMBODIMENTS

Figure 1:
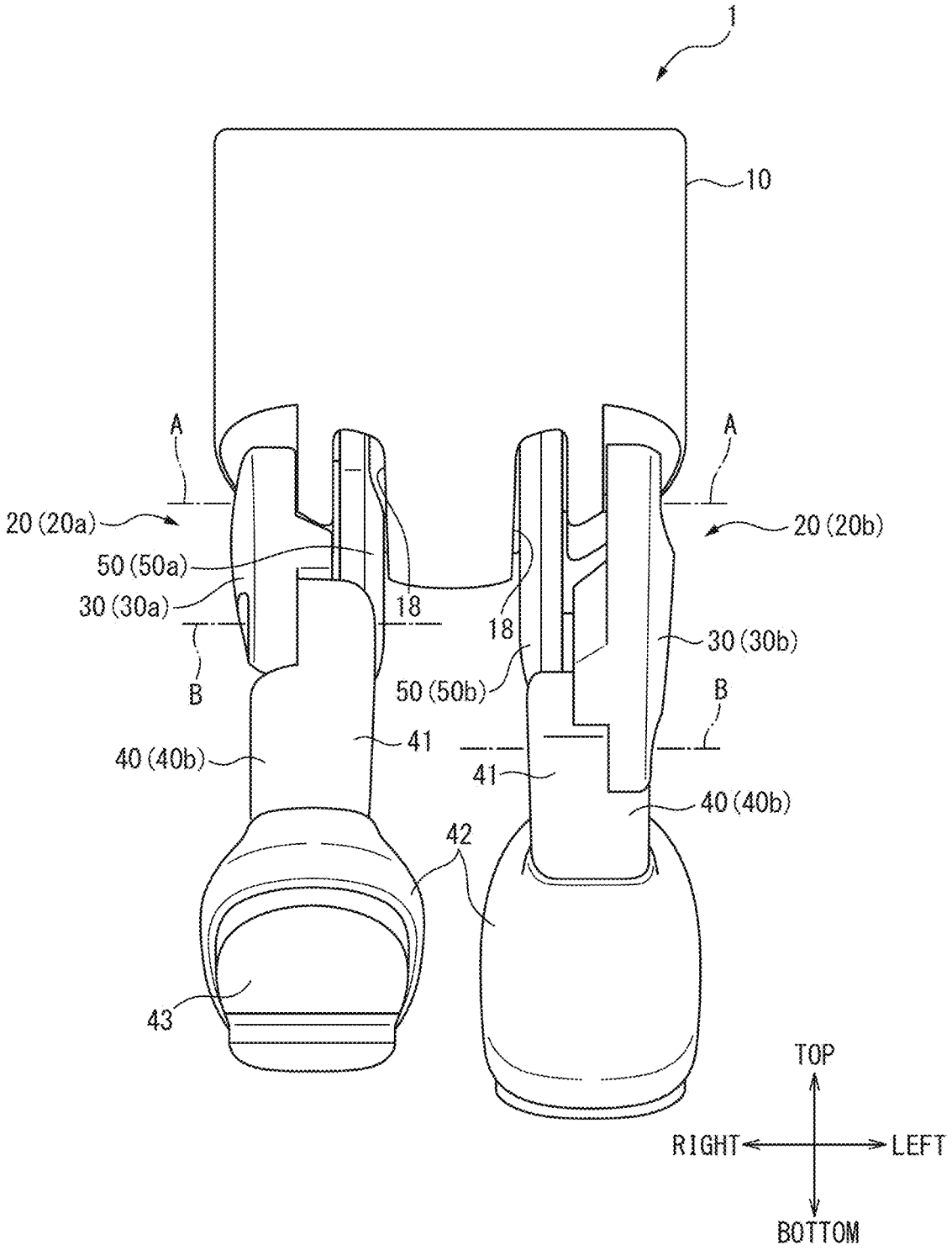
FIG. 1 is a front view of a walking toy.

Below, embodiments will be explained in detail while referring to the drawings. In the following explanation, similar component elements are assigned the same reference notations.

First Embodiment

Configuration of Walking Toy

Figure 2:
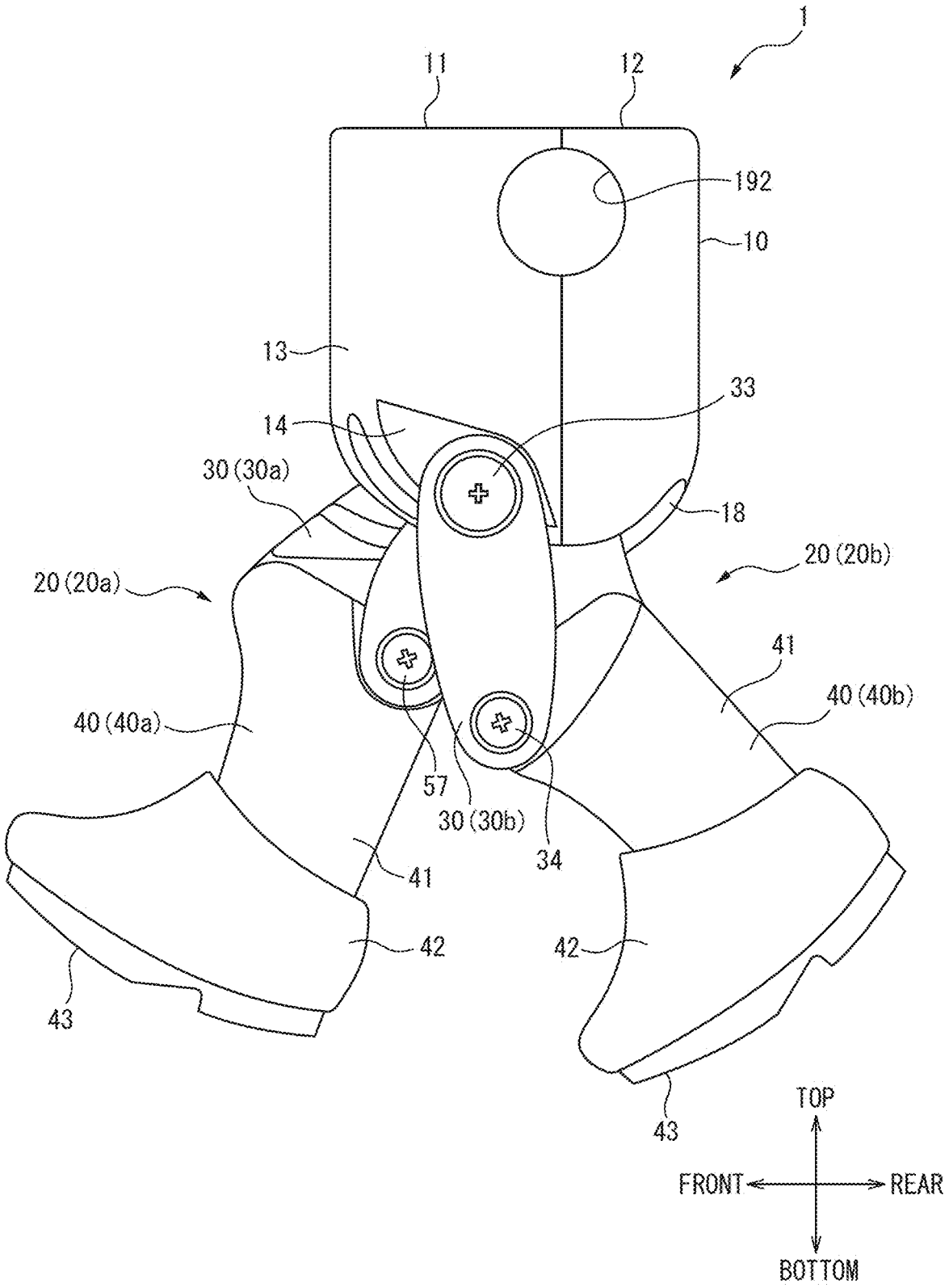
FIG. 2 is a side view of the walking toy in the same walking state as FIG. 1.
Figure 3:
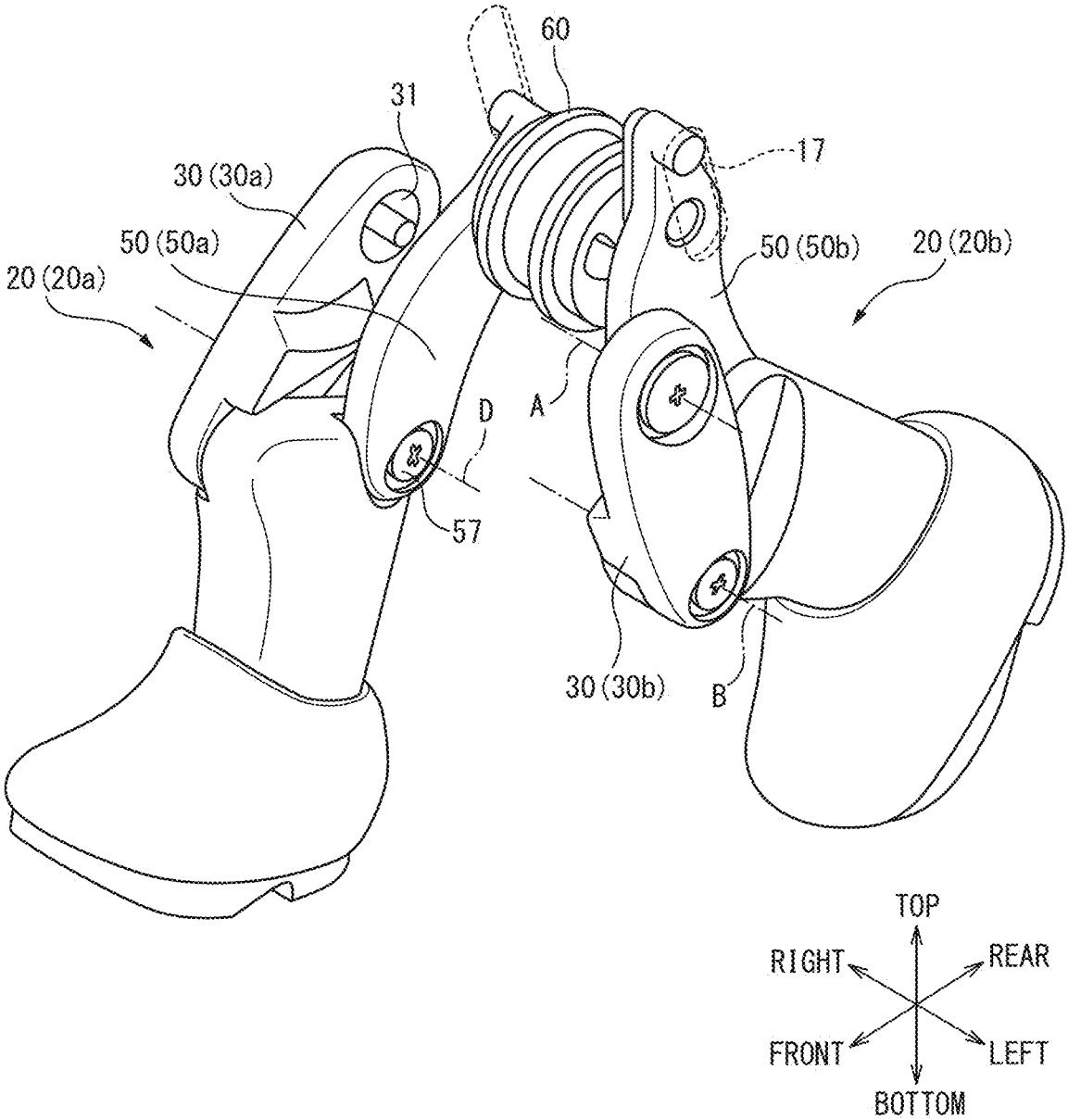
FIG. 3 is a perspective view of the walking toy in which a torso is omitted, in the same walking state as FIG. 1.
Figure 4:
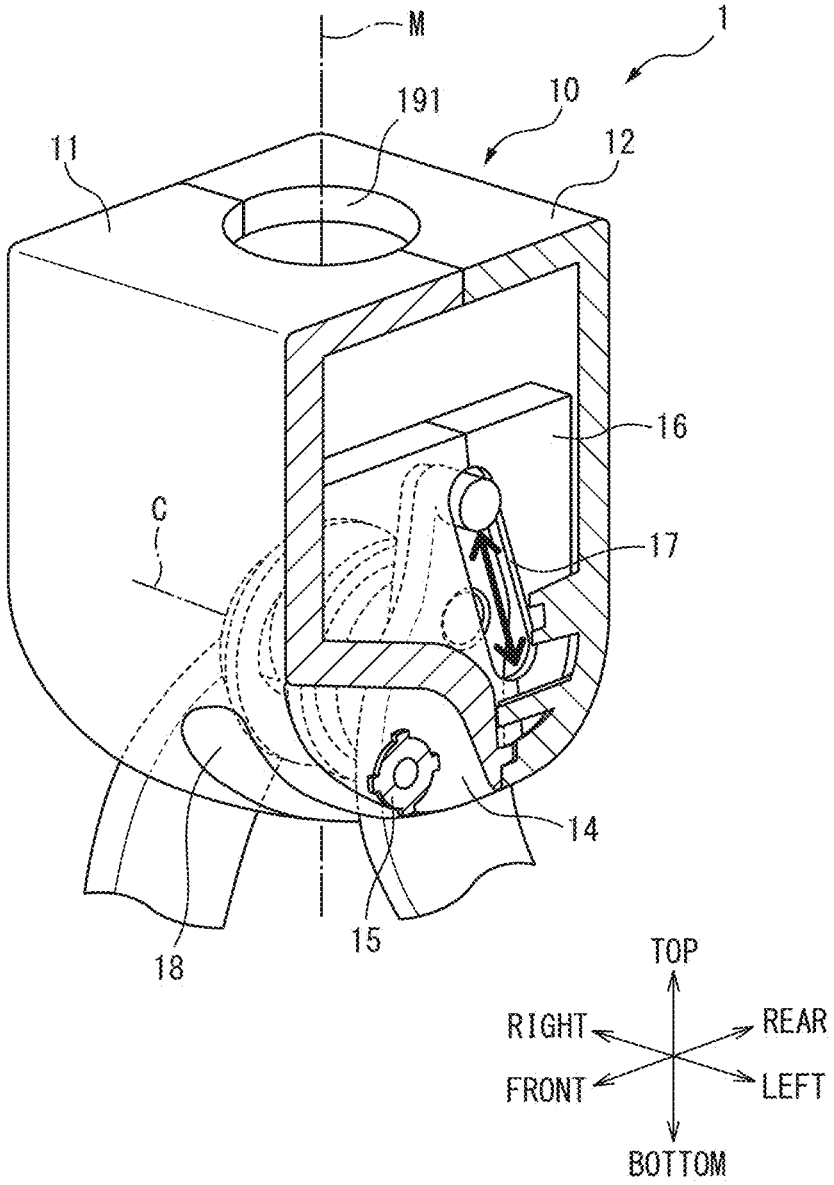
FIG. 4 is a perspective view showing part of the torso and legs of the walking toy.
Figure 5:
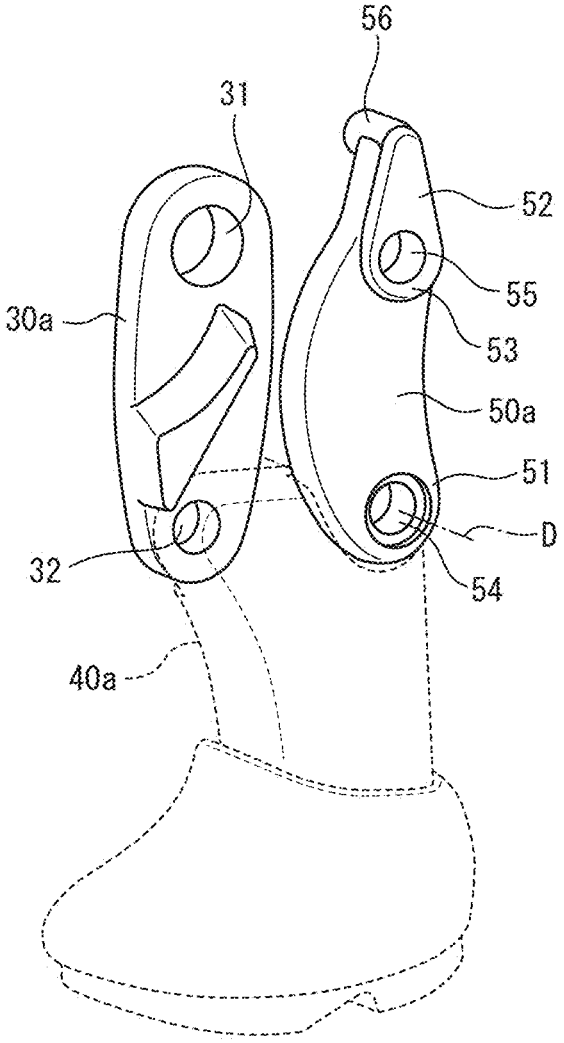
FIG. 5 is a perspective view showing a right leg and a right motion member.

First, referring to FIGS. 1 to 4, a walking toy 1 according to a first embodiment will be explained. FIG. 1 is a front view of the walking toy 1, FIG. 2 is a side view of the walking toy 1 in the same walking state as FIG. 1, and FIG. 3 is a perspective view of the walking toy 1, in which the torso is omitted, in the same walking state as FIG. 1. Further, FIG. 4 is a perspective view showing part of the torso and legs of the walking toy 1. FIG. 5 is a perspective view showing a right leg and right motion member, in which a lower leg part is shown by broken lines.

In this Description, the advancing direction of the walking toy 1 parallel to the walking surface on which the walking toy 1 walks will be referred to as "forward", while the direction in the opposite direction to forward will be referred to as "rearward". Further, the direction vertical to the walking surface on which the walking toy 1 walks and away from the walking surface will be referred to as "upward", while the direction approaching the walking surface will be referred to as "downward". In addition, the right direction and left direction when viewing the walking toy 1 from rearward to forward will be referred to as "rightward" and "leftward", respectively.

As shown in FIGS. 1 to 5, the walking toy 1 is provided with a torso 10, a pair of legs 20 connected to the torso 10, and a crank member 60. In particular, in the present embodiment, the walking toy 1 has two legs 20: a right leg 20*a* provided at the right side when viewing forward and a left leg 20*b* provided at the left side when viewing forward.

Torso

The torso 10 is formed as a hollow member. As shown in FIGS. 2 and 4, in the present embodiment, the torso 10 has a front side half 11 and a rear side half 12. These halves 11, 12 are assembled with each other whereby the torso 10 is formed. Further, the torso 10 has two side walls 13 forming the left and right side surfaces of the torso 10 (each of the side walls 13 is configured from a part of the front side half 11 and a part of the rear side half 12). The side walls 13 have recessed parts 14, at the forward bottom parts, recessed by the same extents as the thicknesses of the upper leg members 30 explained later.

Figure 6:
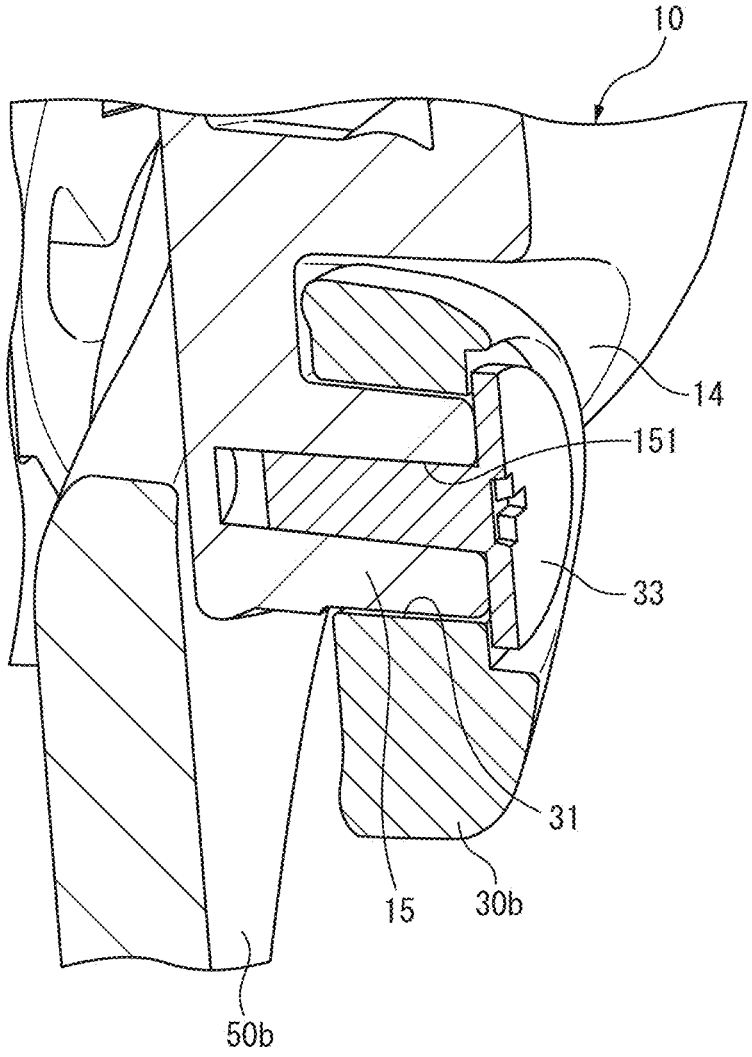
FIG. 6 is a partial cross-sectional view of a left forward bottom part of the torso.

FIG. 6 is a partial cross-sectional view of a left forward bottom part of the torso 10. As shown in FIG. 6, in the recessed part 14, a first boss 15 is formed for connecting the leg 20. At this first boss 15, a bolt hole 151 receiving a first bolt 33 is formed.

Further, the torso 10 is provided, inside of the side walls 13, with a pair of inside walls 16 extending in parallel to the side walls 13, that is, in the front-rear direction (see FIG. 4). The inside walls 16 are provided, one each, at the left side and right side from the center of the torso 10 in the left-right direction. The front side parts of the inside walls 16 are provided at the front side half 11, and the rear side parts of the inside walls 16 are provided at the rear side half 12. Further, between the front side parts and the rear side parts of the inside walls 16, grooves 17 are formed. In particular, in the present embodiment, the grooves 17 are formed so as to be positioned near the center of the torso 10 when viewed from the lateral direction. Further, the grooves 17 are formed so as to be slightly slanted rearward in the downward direction with respect to the center axis M of the top-down direction of the torso 10. Therefore, the grooves 17 are formed so that when the torso 10 is in a state standing upright with respect to the walking surface (that is, when the center axis of the torso 10 extends in the vertical direction), the grooves 17 form an angle with respect to the walking surface (preferably, is vertical to the walking surface or forms a slight angle with respect to the vertical). Further, in the present embodiment, the grooves 17 extends straight.

In addition, the torso 10 has a pair of rod openings 18 at its bottom wall. The rod openings 18 are formed adjoining the corresponding inside walls 16 at the inside from the inside walls 16 in the left-right direction. The openings 18 are formed so as to extend over broad ranges in the front-rear direction. Therefore, parts of the rod openings 18 are formed at the front side half 11 and the remaining parts of the rod openings 18 are formed at the rear side half 12 (see FIG. 2).

Further, in the present embodiment, at the top wall of the torso 10, a head attachment hole 191 is formed for attachment of a head member (not shown) of the walking toy 1 (see FIG. 4). Further, at the left and right side walls 13 of the torso 10, arm attachment holes 192 are formed for attachment of arm members (not shown) of the walking toy 1 (see FIG. 2). These attachment holes 191, 192 are arranged between the front side half 11 and the rear side half 12. The head member and the arm members are connected to the torso 10 by assembling these halves 11, 12 together. The upper body part is configured by attaching the head member and the arm members to the torso 10. Therefore, the upper body part includes the torso 10, the head member, and the arm members. Note that, in the present embodiment, the head member and the arm members are formed as separate members from the torso 10, but the head member and/or the arm members may also be integrally formed with the torso 10. Further, the upper body part may be formed from only the torso not including the head member and/or the arm members, and may also include a tail member or other members other than the torso 10, the head member, and the arm members.

Crank Member

Figure 7:
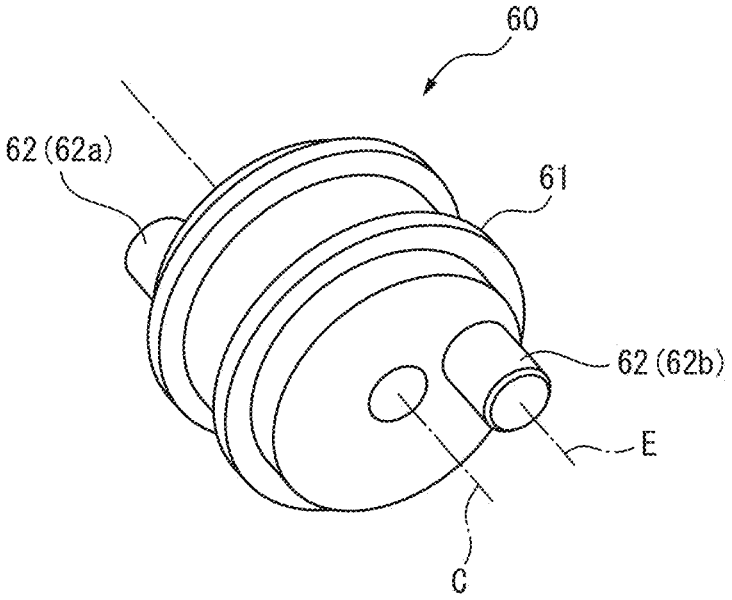
FIG. 7 is a schematic perspective view of a crank member.

FIG. 7 is a schematic perspective view of a crank member 60. The crank member 60 is supported in the torso 10 rotatably about a rotational axis C. The rotational axis C of the crank member 60 extends perpendicularly to the vertical plane including the advancing direction of the walking toy 1. Further, in the present embodiment, the rotational axis C extends in parallel with a pivot axis A of the upper leg member 30. In the present embodiment, the crank member 60 is arranged at the center of the torso 10 in the left-right direction, and at the center of the torso 10 in the front-rear direction. Note that, the crank member 60 may be arranged at a position offset from the center of the torso 10 in the front-rear direction. Further, in the present embodiment, the crank member 60 is arranged in the cylindrically shaped space formed between the front side half 11 and the rear side half 12 of the torso 10.

The crank member 60 has a cylindrically shaped main body 61 and a pair of crank eccentric shafts 62. The cylindrically shaped main body 61 is arranged in the torso 10 so that its outer circumferential surface faces the inner circumferential surface defining the cylindrically shaped space of the torso 10. Further, the cylindrically shaped main body 61 is arranged between the pair of rod openings 18 formed in the torso 10 so that the side surfaces of the main body 61 face the corresponding rod openings 18.

The pair of crank eccentric shafts 62 are respectively positioned eccentrically from the rotational axis C of the crank member 60, and project in the left-right direction from the circular side surfaces of the cylindrically shaped main body 61. Therefore, the right crank eccentric shaft 62*a* projects out from the right side surface of the cylindrically shaped main body 61 in the right direction, while the left crank eccentric shaft 62*b* projects out from the left side surface of the cylindrically shaped main body 61 in the left direction. Further, the crank eccentric shafts 62 traverse the rod openings 18 at least partially in the left-right direction, and project from the cylindrically shaped main body 61 so as to connect with the later explained motion members 50 in the rod openings 18. The crank eccentric shafts 62 are formed so that their axes E are parallel to the rotational axis C of the crank member 60. Further, the pair of crank eccentric shafts 62 are arranged so that they are opposite phases from each other with respect to the rotational axis C of the crank member 60.

Legs

Each of the legs 20 has an upper leg member 30, a lower leg member 40, and a motion member 50. Therefore, the right leg 20*a* has a right upper leg member 30*a*, right lower leg member 40*a*, and right motion member 50*a*, while the left leg 20*b* has a left upper leg members 30*b*, left lower leg member 40*b*, and left motion member 50*b*.

The upper leg members 30 are members corresponding to the thighs, and are formed in elongated plate shapes. The top parts of the upper leg members 30 (in particular, the top end parts) are connected to the torso 10 pivotably in the front-rear direction. In the present embodiment, the right upper leg member 30*a* is connected to the bottom part of the side wall 13 at the right side of the torso 10, while the left upper leg member 30*b* is connected to the bottom part of the side wall 13 at the left side of the torso 10.

In particular, in the present embodiment, as shown in FIGS. 5 to 6, at the top part of each upper leg member 30 (in particular, the top end part), a cylindrically shaped opening 31 is formed. As shown in FIG. 6, by screwing a first bolt 33 into a bolt hole 151 of the torso 10 in the state where a first boss 15 formed at the torso 10 is fit into the opening 31, the upper leg member 30 is connected to the torso 10. As a result, the top part of the upper leg member 30 is connected to the torso 10 so that the upper leg member 30 can pivot in the front-rear direction with respect to the torso 10 about the axis of the first boss 15 or first bolt 33. However, the upper leg member 30 may also be connected the lower parts of the side walls of the torso 10 in any way so long as being able to pivot in the front-rear direction with respect to the torso 10 centered on the top part of the upper leg member 30.

The lower leg members 40 are parts corresponding to the lower legs and feet, and have lower leg parts 41 corresponding to the lower legs and foot parts 42 corresponding to the feet. Therefore, the foot parts 42 are formed so as to stick out forward from the lower leg parts 41.

The top parts of the lower leg members 40 are connected to the bottom parts of the upper leg members 30 pivotably in the front-rear direction. In particular, in the present embodiment, the top end parts of the lower leg members 40 are pivotably connected to the bottom end parts of the upper leg members 30 so that the connecting parts of the upper leg members 30 and lower leg members 40 appear like knee joints. Therefore, the top end part of the right lower leg member 40*a* is connected to the bottom end part of the right upper leg member 30*a*, while the top end part of the left lower leg member 40*b* is connected to the bottom end part of the left upper leg member 30*b*.

In particular, in the present embodiment, at the bottom parts of the upper leg members 30, cylindrically shaped openings 32 are formed (see FIG. 5). Further, at the top parts of the lower leg members 40, second bosses extending toward the outside in the left-right direction are formed. Further, in the same way as the method of connection shown in FIG. 6, in the state with the second bosses formed at the lower leg members 40 fit in the openings 32 of the upper leg members 30, second bolts 34 are screwed into the bolt holes formed at the centers of the second bosses, whereby the upper leg members 30 are connected to the top parts of the lower leg members 40. As a result, the top parts of the lower leg members 40 are connected to the bottom parts of the upper leg members 30 so that the lower leg members 40 can pivot with respect to the upper leg members 30 in the front-rear direction about the axes of the second bolts (second bosses). In particular, in the present embodiment, the pivot axes B of the lower leg members 40 are parallel to the pivot axes A of the upper leg members 30. Note that, the lower leg members 40 may be connected to the bottom parts of the upper leg members 30 in any way as long as being able to pivot with respect to the upper leg members 30 in the front-rear direction centered on the top part.

The foot parts 42 have contact surfaces 43 contacting the walking surface when the walking toy 1 is walking. In the present embodiment, the contact surfaces 43 are formed in arc shapes projecting toward the walking surface in the front-rear direction. In particular, in the present embodiment, the contact surfaces 43 are formed in substantially arc shapes centered on the vicinities of the top ends of the lower leg members 40, in particular the vicinities of the connecting parts of the lower leg members 40 with the upper leg members 30. At this time, the contact surfaces 43 may also be formed as arc shapes with single centers, or may be formed as at least two arc shapes with different centers between forward parts and rearward parts of the contact surfaces 43. By the contact surfaces 43 being formed in arc shapes in this way, when the walking toy 1 is walking on the walking surface, the lower leg members 40 will are more resistant to tripping at the walking surface.

The motion members 50 give rotational force to the crank member 60, when the torso 10 is made to move forward in the state where one leg 20 contacts the walking surface. In the present embodiment, the motion members 50 are formed as straight rods. In particular, in the present embodiment, the motion members 50 have the right motion member 50*a* arranged at the right side from the crank member 60, and the left motion member 50*b* arranged at the left side from the crank member 60. The motion members 50 respectively have action parts 51, torso cooperation parts 52, and eccentric shaft connecting parts 53. In the present embodiment, the action parts 51 are positioned at the bottom end parts of the motion members 50, while the torso cooperation parts 52 are positioned at the top end parts. The eccentric shaft connecting parts are positioned between the action parts 51 and the torso cooperation parts 52. As shown in FIGS. 1 to 4, the motion members 50 are partially arranged in the rod openings 18 formed at the torso 10.

The action parts 51 of the motion members 50 are pivotably connected to the corresponding lower leg members 40. Therefore, the action part 51 of the right motion member 50*a* is pivotably connected to the right lower leg member 40*a*, while the action part 51 of the left motion member 50*b* is pivotably connected to the left lower leg member 40*b*. Further, the action parts 51 of the motion members 50 are connected to the corresponding lower leg members 40 at positions different from the connecting parts to the upper leg members 30. In the present embodiment, the action parts 51 of the motion members 50 are connected to the corresponding lower leg members 40 rearward from of the connecting points to the upper leg members 30.

In particular, in the present embodiment, at the action parts 51 of the motion members 50, cylindrically shaped openings 54 are formed (see FIG. 5). Further, at the top parts of the lower leg members 40 rearward from the second bosses (connecting parts with upper leg members 30), third bosses extending toward the inside in the left-right direction are formed. Further, in the same way as the method of connection shown in FIG. 6, in the state with the third bosses formed at the lower leg members 40 fit in the openings 54 of the motion members 50, third bolts 57 are screwed into the bolt holes formed at the centers of the third bosses, whereby the motion members 50 are connected to the rear parts of the top ends of the lower leg members 40. As a result, the action parts 51 of the motion members 50 are connected to the top rear parts of the lower leg members 40 so that the motion members 50 can pivot about the axes of the third bolts (third bosses) with respect to the lower leg members 40. In particular, in the present embodiment, the pivot axes D about which the motion members 50 pivot with respect to the lower leg members 40 are parallel to the pivot axes A of the upper leg members 30. Note that, the motion members 50 may be connected to the lower leg members 40 in any way as long as being able to pivot with respect to the lower leg members 40 centered on the action parts 51.

The eccentric shaft connecting parts 53 of the motion members 50 are pivotably connected to the corresponding crank eccentric shafts 62. Therefore, the eccentric shaft connecting part 53 of the right motion member 50*a* is pivotably connected to the right crank eccentric shaft 62*a*, while the eccentric shaft connecting part 53 of the left motion member 50*b* is pivotably connected to the left crank eccentric shaft 62*b*.

In particular, in the present embodiment, at the eccentric shaft connecting parts 53 of the motion members 50, cylindrically shaped openings 55 are formed. The corresponding crank eccentric shafts 62 are fit into the openings 55. Therefore, the right crank eccentric shaft 62*a* is fit into the opening 55 of the right motion member 50*a*, while the left crank eccentric shaft 62*b* is fit into the opening 55 of the left motion member 50*b*. As a result, the eccentric shaft connecting parts 53 of the motion members 50 are connected to the crank eccentric shafts 62 so that the motion members 50 can pivot about the axes E of the crank eccentric shafts 62.

At the torso cooperation parts 52 of the motion members 50, cylindrically shaped projections 56 are formed. The projections 56 are formed so as to extend from the torso cooperation parts 52 of the motion members 50 toward the outside in the left-right direction. Therefore, the right projection 56*a* extends in the right direction from the torso cooperation part 52 of the right motion member 50*a*, while the left projection 56*b* extends in the left direction from the torso cooperation part 52 of the left motion member 50*b*.

The projections 56 of the motion members 50 are housed in the grooves 17 so as to be able to slide in the grooves 17 formed in the inside walls 16 of the torso 10. Therefore, the projections 56 of the motion members 50 are guided along the grooves 17.

Walking Motion of Walking Toy

The walking toy 1 configured as explained above walks by the legs 20, by the user using his hands, etc., to push the torso 10 forward to make the torso 10 move forward, in the state where the contact surface of at least one of the legs 20 contacts the walking surface. Below, referring to FIGS. 8 to 11, the walking motion of the walking toy 1 configured as explained above will be explained. FIGS. 8 to 11 are side views showing different walking states of the walking toy 1. FIGS. 8 to 11 show in order the actuating states of the walking toy 1 from the state where the left leg 20*b* is positioned forward most to the state where the right leg 20*a* is positioned forward most.

Note that, a point A in the figures shows the position of a pivot axis A of the left upper leg member 30*b* with respect to the torso 10, a point B shows the position of a pivot axis B of the left lower leg member 40*b* with respect to the left upper leg member 30*b*, a point D shows the position of a pivot axis D of the left motion member 50*b* with respect to the left lower leg member 40*b*, a point E shows an axis E of the left crank eccentric shaft 62*b*, and a point F shows an axis of the left projection 56*b* of the left motion member 50*b*. Further, a line X in the figures is a line connecting the point A and the point B and shows the position of the left upper leg member 30*b*. A line Y in the figures is a line connecting the point B and the point D and shows the position of the left lower leg member 40*b*. A line Z in the figures is a line connecting the point D, the point E, and the point F and shows the position of the left motion member 50*b*. Note that, the point D, the point E, and the point F are on the same straight line, therefore the line Z is a straight line in the present embodiment, but the point D, the point E, and the point F are not necessarily limited to being positioned on the same straight line. Accordingly, the line Z is not necessarily limited to being a straight line.

Further, a broken line "b" in the figures shows a path of the point B per cycle, a one-dot chain line "d" shows a path of the point D per cycle, a broken line "e" shows a path of the point E per cycle, and a one-dot chain line "f" shows a path of the point F per cycle. In particular, the point E rotates counterclockwise (direction of arrow mark in FIG. 8) along the broken line "e".

Figure 8:
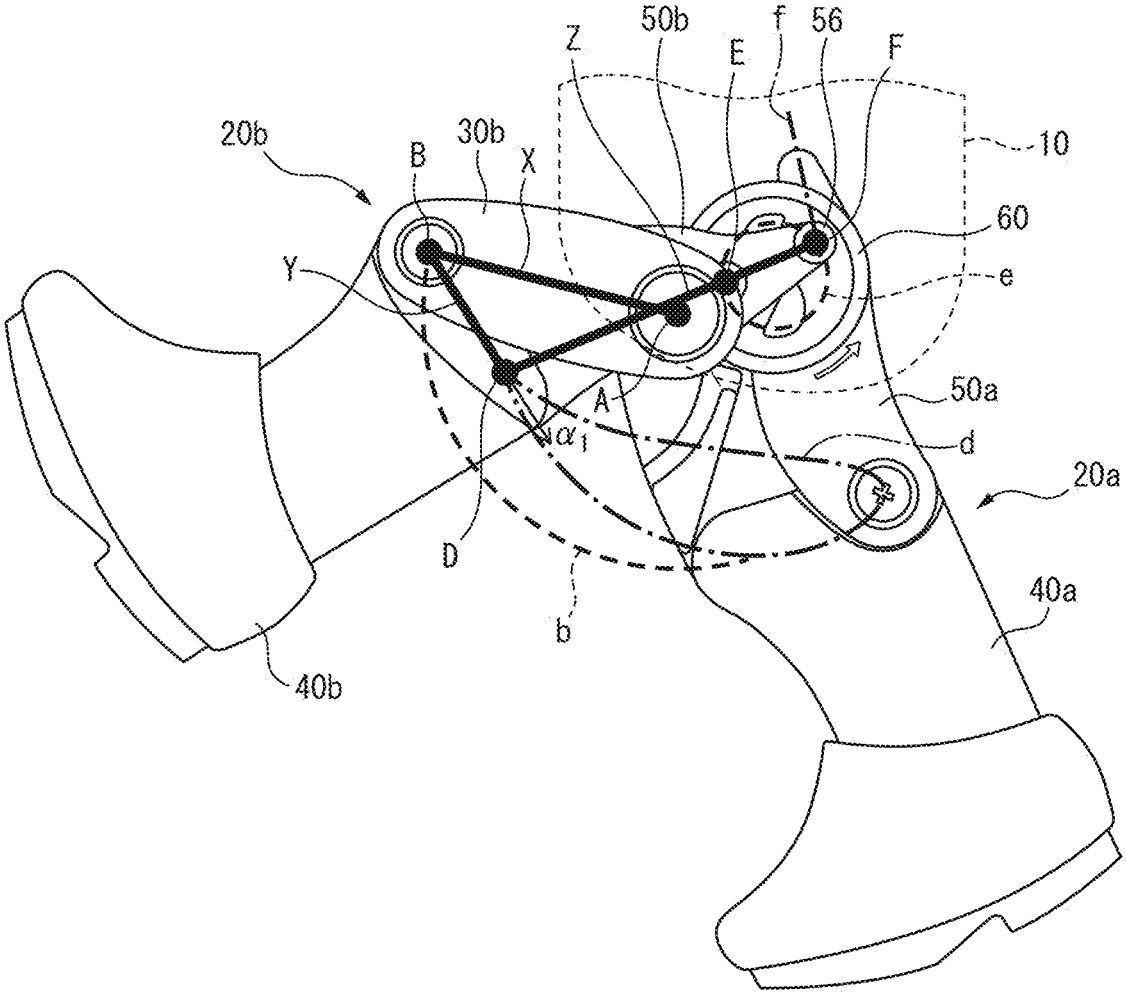
FIG. 8 shows a walking state of the walking toy when a left leg not contacting the walking surface is positioned at a forward most place.

FIG. 8 shows the walking state of the walking toy 1 when the left leg 20*b* not contacting the walking surface is positioned forward most, that is, when the point B is positioned forward most. As shown in FIG. 8, at this time, the left upper leg member 30*b* (line X) is positioned forward most in its range of movement, the left crank eccentric shaft 62*b* is positioned substantially forward most in its range of movement (point E is positioned substantially forward most in path "e"), and the projection 56 of the left motion member 50*b* (point F) is positioned downward in the groove 17.

In the state shown in FIG. 8, the right leg 20*a* contacts the ground, therefore if forward force is applied to the torso 10 from the outside, the right leg 20*a* receives rearward force relative to the torso 10. By such force being applied to the right leg 20*a*, as explained later, the crank member 60 receives a counterclockwise force. Along with this, a tangential direction force acts on the left crank eccentric shaft 62*b* (point E). The projection 56 of the left motion member 50*b* (point F) is limited in movement in a direction perpendicular to the direction in which the groove 17 extends, in the groove 17 of the torso 10, therefore cannot move much at all in the tangential direction of the left crank eccentric shaft 62*b* (point E), and accordingly functions as a point of support. As a result, at the left motion member 50*b* (line Z), the point E acts as the point of force, the point F acts as the point of support, and the point D acts as the point of action, and a force is applied to the point D in the direction of the arrow mark $\alpha_1$. Further, due to the gravitational force acting on the left lower leg member 40*b* as well, force is applied to the left leg 20*b* in a direction lowering it. As a result, the raised left leg 20*b* is lowered.

Figure 9:
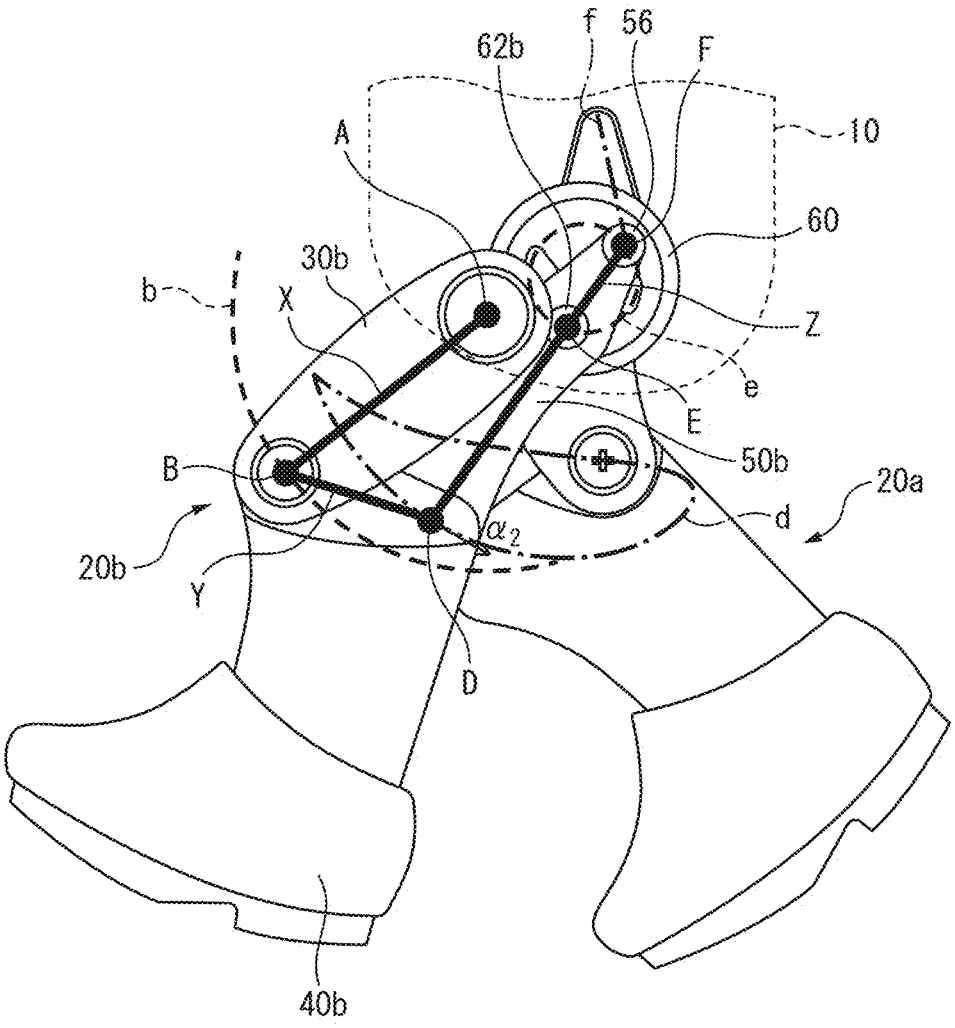
FIG. 9 shows a walking state of the walking toy when the left leg is lowered and a contact surface of the left leg contacts the walking surface.

FIG. 9 shows the walking state of the walking toy 1 when the left leg 20*b* is lowered and the contact surface 43 (specifically, the heel part) of the left leg 20*b* contacts the walking surface. In the present embodiment, at this time, as shown in FIG. 9, the left crank eccentric shaft 62*b* (point E) is positioned in the vicinity of the bottommost point in its range of movement (point E is positioned at the substantially bottommost point of the path "e"), and the projection 56 of the left motion member 50*b* is positioned downward in the groove 17.

In the state shown in FIG. 9, the left leg 20*b* contacts the ground, therefore due to the weight of the walking toy 1 and/or the downward force on the torso 10 from the outside, the left lower leg member 40*b* of the left leg 20*b* receives upward force from the walking surface. Further, if forward force is applied to the torso 10 from the outside, the left lower leg member 40*b* of the left leg 20*b* receives rearward force relative to the torso 10 from the walking surface. As a result, an upward force and rearward force are applied to the point D of the left motion member 50*b* (line Z).

The projection 56 of the left motion member 50*b* (point F) is limited in movement in a direction perpendicular to the direction in which the groove 17 extends, in the groove 17 of the torso 10, therefore cannot move in the direction of the arrow mark $\alpha_2$ and accordingly functions as a point of support. As a result, at the left motion member 50*b* (line Z), the point D acts as the point of force, the point F acts as the point of support, and the point E acts as the point of action. For this reason, at the left crank eccentric shaft 62*b* (point E), in addition to force in the axial direction of the left motion member 50*b* (line Z direction force), a rearward oriented tangential direction force such as shown by the arrow marks $\alpha_2$ in the figures is applied. Accordingly, a rotational force is applied to the point E, and the crank member 60 rotates counterclockwise. By such rotation of the crank member 60, the right leg 20*a* moves forward upward. In this way, by the right leg 20*a* which previously had been contacting the walking surface moving upward, the right leg 20*a* separates from the walking surface, and accordingly the leg contacting the ground is switched from the right leg 20*a* to the left leg 20*b*. In particular, in the present embodiment, the crank member 60 rotates counterclockwise in FIG. 9, therefore the path "d" of the pivot axis D of the motion member 50 of the leg 20 not contacting the ground is higher than the path "d" of the pivot axis D of the leg contacting the ground. In other words, the paths "d" of the pivot axes D of the motion members 50 of the legs 20 are generally higher when the legs 20 are not contacting the ground, than when the legs 20 are contacting the ground. The pivot axes D of the motion members 50 are positioned rearward of the pivot axes B corresponding to the knee joints, and the lower leg members 40 can pivot about the pivot axes B. Therefore due to the above-mentioned height difference in the path "d", when the leg 20 which had been contacting the walking surface separates from the walking surface and moves forward, the relative angle of the lower leg member 40 with respect to the upper leg member 30 changes so that the knee joint of this leg 20 bends.

Figure 10:
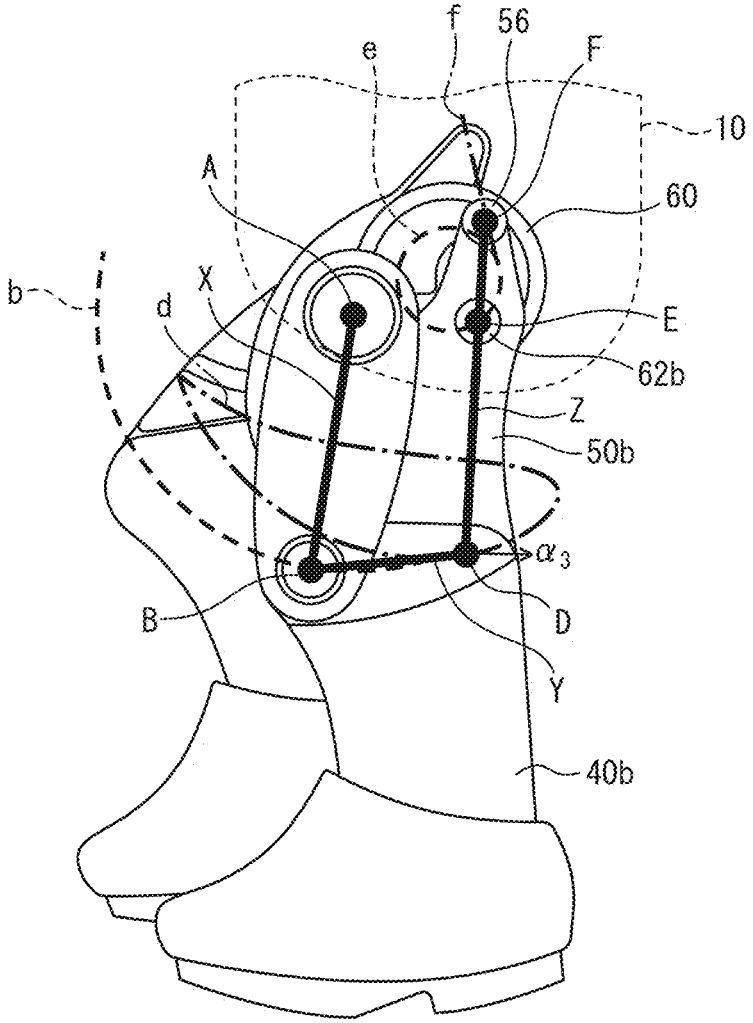
FIG. 10 shows a walking state of the walking toy when a right leg not contacting the walking surface has moved forward from the left leg.

FIG. 10 shows the walking state of the walking toy when the right leg 20*a* not contacting the walking surface has moved forward from the left leg 20*b*. In the present embodiment, at this time, as shown in FIG. 10, the left crank eccentric shaft 62*b* (point E) is positioned slightly rearward from the vicinity of the bottommost position in its range of movement (point E is positioned slightly to the rear upward from the bottommost position of the path "e"), and the projection 56 of the left motion member 50*b* (point F) is positioned upward from the time of the walking state shown in FIG. 9 in the groove 17. Further, the left motion member 50*b* extends substantially in the up-down direction (vertical direction).

In the state shown in FIG. 10 as well, the left leg 20*b* contacts the ground, therefore the left lower leg member 40*b* of the left leg 20*b* receives upward force from the walking surface. Further, forward force from the outside is applied to the torso 10, therefore the left lower leg member 40*b* of the left leg 20*b* receives rearward force relative to the torso 10 from the walking surface. As a result, in the state shown in FIG. 10 as well, an upward force and rearward force are applied to the point D of the left motion member 50*b* (line Z). In other words, axial direction force of the left motion member 50*b* (line Z direction force) and rearward oriented tangential direction force shown by the arrow mark $\alpha_3$ in the figure are applied to the point D.

The projection 56 of the left motion member 50*b* is limited in motion in the direction perpendicular to the direction in which the groove 17 extends, in the groove 17 of the torso 10, therefore the projection 56 cannot move in the direction of the arrow mark $\alpha_3$, and accordingly functions as a point of support. As a result, in the left motion member 50*b* (line Z), the point D acts as the point of force, the point F acts as the point of support, and the point E acts as the point of action. Accordingly, a rearward force is applied to the left crank eccentric shaft 62*b* (point E). Further, as explained above, an axial direction upward force is applied to the left motion member 50*b*, therefore an upward force is also applied to the left crank eccentric shaft 62*b* (point E). As a result, a rearward upward force, that is, a rotational force, is applied to the left crank eccentric shaft 62*b* and the crank member 60 rotates counterclockwise. By such rotation of the crank member 60, the right leg 20*a* further moves forward and upward.

Figure 11:
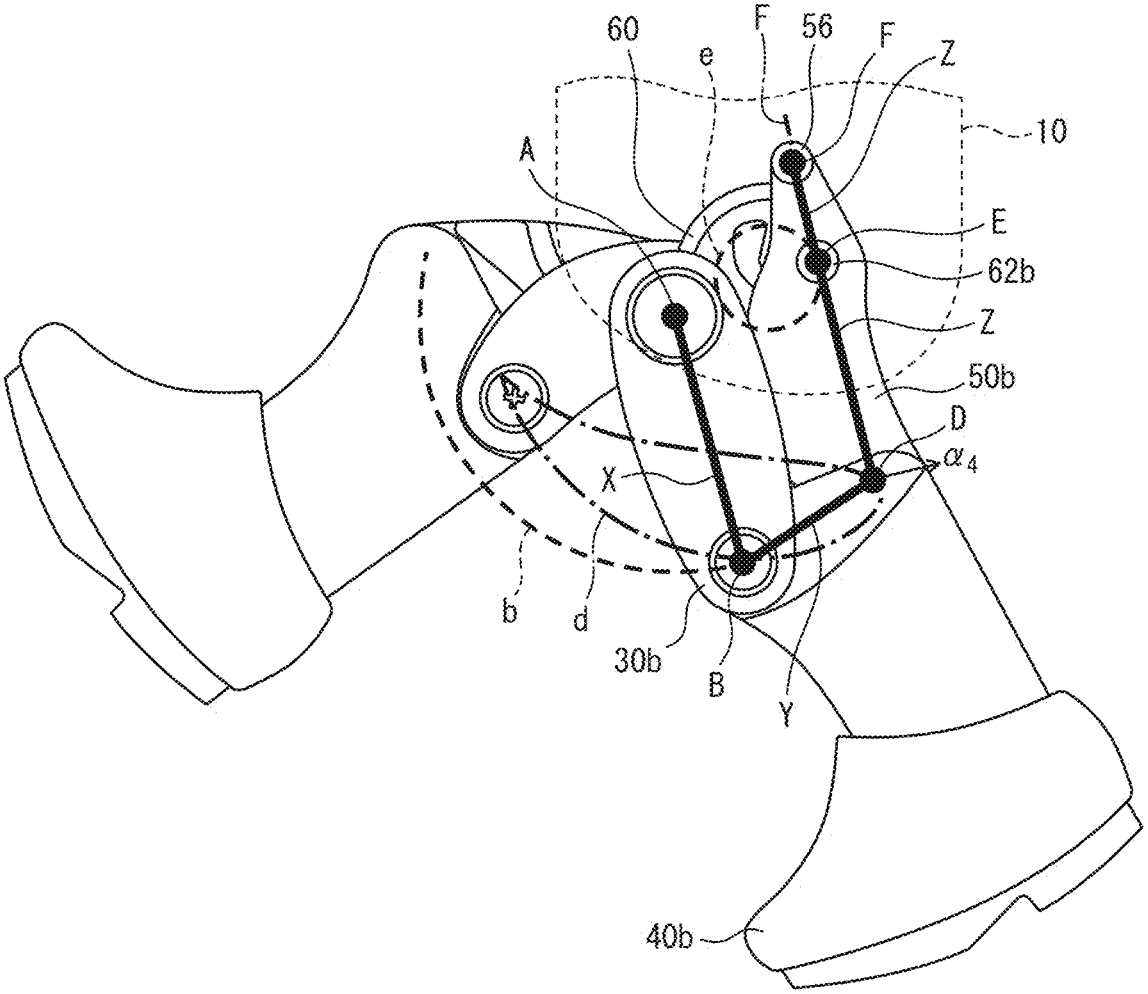
FIG. 11 shows a walking state of the walking toy when the right leg not contacting the walking surface is positioned at a forward most place.

FIG. 11 shows the walking state of the walking toy 1 when the right leg 20*a* not contacting the walking surface is positioned at the forward most position. Therefore, FIG. 11 shows the state reversed left to right from the walking state shown in FIG. 8. In the present embodiment, at this time, as shown in FIG. 11, the left crank eccentric shaft 62*b* is positioned at substantially the rearward most place in its range of movement (point E is positioned at substantially rearward most place of path "e"), and the projection 56 of the left motion member 50*b* is positioned in the vicinity of the center in the groove 17.

In the state shown in FIG. 11 as well, the left lower leg member 40*b* of the left leg 20*b* receives an upward force from the walking surface. Further, the left lower leg member 40*b* of the left leg 20*b* receives a rearward force relative to the torso 10. As a result, in the state shown in FIG. 11 as well, an upward force and rearward force are applied to the point E of the left motion member 50*b* (line Z). Therefore, force in the axial direction of the left motion member 50*b* (force in line Z direction) and rearward force in the tangential direction such as shown by the arrow mark $\alpha_4$ in the figure are applied to the point E.

The projection 56 (point F) of the left motion member 50*b* is limited in movement in a direction perpendicular to the direction in which the groove 17 extends, in the groove 17 of the torso 10, therefore the projection 56 cannot move in the direction of the arrow mark $\alpha_4$. Further, the left crank eccentric shaft 62*b* is positioned at substantially the rearward most position in its range of movement, therefore the left crank eccentric shaft 62*b* (point E) does not move rearward. Therefore, even if a rearward force $\alpha_4$ in the tangential direction is applied to the point D, the point D will not move rearward. Accordingly, the projection 56 functions as a point of support limiting movement of the left motion member 50*b* so that the point D will not move rearward further. On the other hand, an upward force in the axial direction is applied to the left motion member 50*b*, therefore an upward force, that is, a rotational force, is applied to the left crank eccentric shaft 62*b* (point E). As a result, the crank member 60 is made to rotate counterclockwise, and along with this, the right leg 20*a* moves downward. Further, force is applied to the right leg 20*a* in a downward direction due to gravity acting on the right lower leg member 40*a* as well.

Then, the contact surface of the right leg 20*a* contacts the walking surface. After that, an operation similar to the operation of the left leg 20*b* shown in FIGS. 8 to 11 is performed at the right leg 20*a*. As a result, while the right leg 20*a* is moving rearward with respect to the torso 10, the left leg 20*b* not contacting the walking surface moves forward. Further, such an operation is alternately repeated at the left and right legs, whereby the walking toy 1 walks on the walking surface.

If referring to FIGS. 8 to 11, the walking toy 1 according to the present embodiment performs walking motion, if the torso 10 is made to move forward with respect to the walking surface to make the lower leg member 40 of the one of the legs 20 contacting the walking surface move rearward relative to the torso 10.

Here, in the walking toy 1 according to the present embodiment, the projections 56 formed at the motion member 50 are guided in the grooves 17 formed in the torso 10. Therefore, the projections 56 formed at the motion members 50 and the grooves 17 of the torso 10 constitute guide mechanisms guiding the torso cooperation parts 52 of the motion members 50 with respect to the torso 10. Therefore, the projections 56 formed at the motion members 50 and the grooves 17 of the torso 10 form movement limiting mechanisms limiting the range by which the torso cooperation parts 52 of the motion members 50 can move with respect to the torso 10.

In the present embodiment, since the range, in which the torso cooperation parts 52 of the motion members 50 can move with respect to the torso 10, is limited, if the torso 10 moves forward with respect to the walking surface and the lower leg member 40 of the one of the legs 20 contacting the walking surface moves rearward relative to the torso 10, the motion member 50 connected to this lower leg member 40 moves to apply rotational force to the crank member 60 by this motion member 50. In other words, the movement limiting mechanism is configured so that, when the lower leg member 40 of the one of the legs 20 contacting the walking surface moves rearward relative to the torso 10, the motion member 50 connected to this lower leg member 40 applies a rotational force to the crank member 60 by this motion member 50. When such a rotational force is applied and the crank member 60 rotates, due to this rotation, the lower leg member 40 of the other leg 20 is moved forward in the state separated from the walking surface.

If changing the viewpoint, in the walking toy 1 according to the present embodiment, due to the projections 56 formed at the motion members 50 and the grooves 17 of the torso 10, if the torso 10 moves forward with respect to the walking surface to make the lower leg member 40 of the one leg 20 contacting the walking surface move rearward relative to the torso 10, the one motion member 50 connected to the lower leg member 40 of the one leg 20 will pivot rearward about the torso cooperation part 52 as a point of support. Therefore, the projections 56 of the motion members 50 and the grooves 17 of the torso 10 form support point mechanisms making the torso cooperation parts 52 of the motion members 50 function as point of supports.

If, due to the support point mechanism, one motion member 50 pivots rearward using that torso cooperation part 52 as a point of support, rotational force is applied to the crank member 60 by the one pivoting motion member 50. Further, if such rotational force is applied and the crank member 60 rotates, due to the rotation, the lower leg member 40 of the other leg 20 is moved forward in the state separated from the walking surface.

As stated above, according to the present embodiment, when the torso 10 moves forward in the state with the contact surface of one leg 20 contacting the walking surface, the other leg 20 is moved forward through rotation of the crank member 60, then this other leg 20 contacts the walking surface.

Advantageous Effects

In the walking toy 1 according to the present embodiment, as explained above, due to the gravitational force of the walking toy 1 itself and in some cases due to the user pushing the walking toy 1 on the walking surface, the legs 20 receive an upward force from the walking surface. Further, by the user making the walking toy 1 move forward, the legs 20 receive a rearward force from the walking surface due to the frictional force. Further, due to the actions of the guide mechanisms, movement limiting mechanisms or support point mechanisms which are formed from the projections 56 of the motion members 50 and the grooves 17 of the torso 10, the upward force and rearward force applied to the legs 20 are converted to rotational force applied to the crank eccentric shafts 62. As a result, when force is applied to the crank eccentric shafts 62 in the rotational direction, the crank member 60 rotates. Further, by such an operation being repeatedly performed at the two left and right legs, the crank member 60 can continuously rotate and accordingly the walking toy 1 can continuously walk.

Therefore, according to the present embodiment, due to the guide mechanisms, movement limiting mechanisms, or support point mechanisms which are formed from the projections 56 of the motion members 50 and the grooves 17 of the torso 10, using simple mechanisms, it is possible to make the crank member 60 stably rotate and accordingly possible to make the walking toy 1 stably walk by a small number of parts.

Modification

Figure 12:
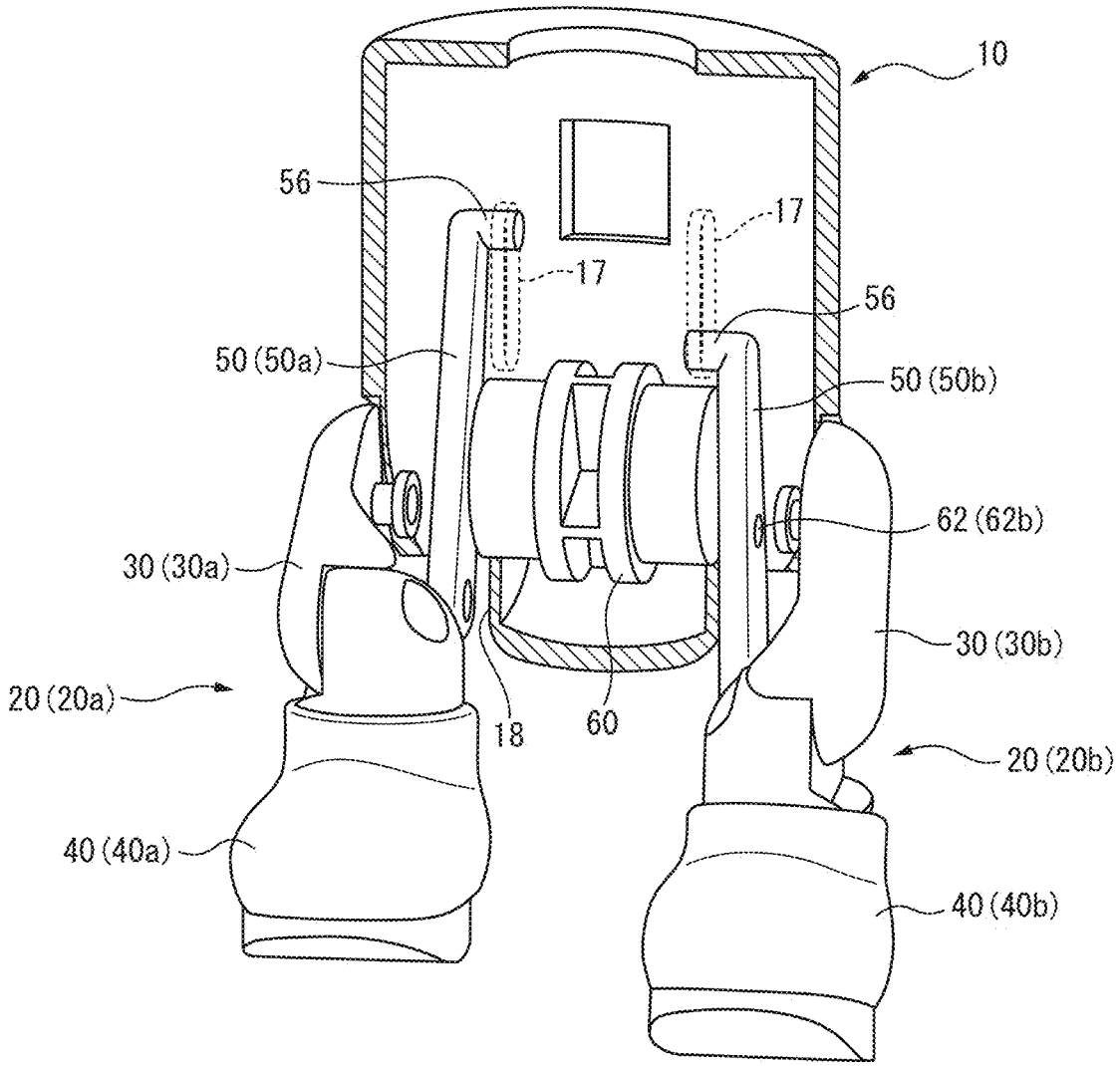
FIG. 12 is a perspective view of a walking toy according to a modification of the first embodiment.
Figure 13:
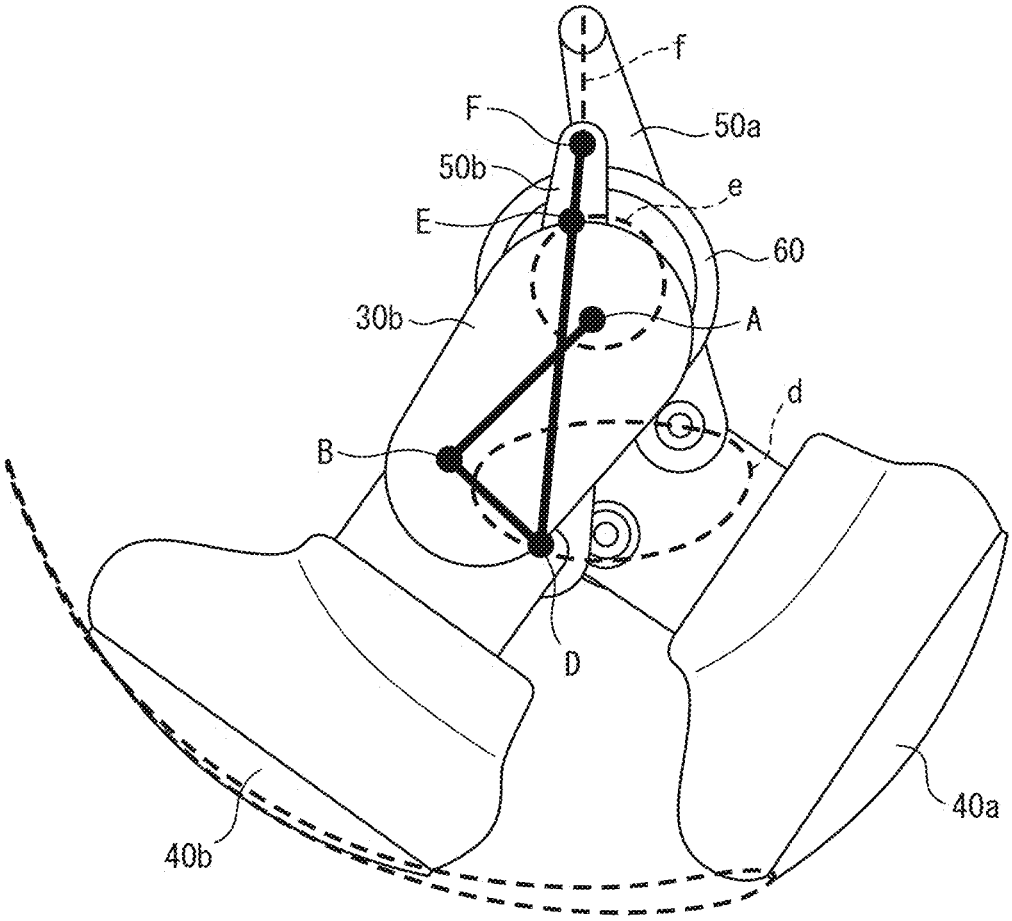
FIG. 13 is a side view similar to FIG. 9 of the walking toy according to a modification of the first embodiment.

Below, a modification of the walking toy 1 according to the first embodiment will be explained. FIGS. 12 to 13 explain the walking toy 1 according to one modification. FIG. 12 is a perspective view of the walking toy 1 according to the present modification where part of the torso 10 is omitted. FIG. 13 is a side view similar to FIG. 9 of the walking toy 1 according to the present modification. The walking toy 1 according to the present modification is basically configured in the same way as the walking toy 1 according to the first embodiment, therefore below, the explanation will be given centered about parts different from the walking toy 1 according to the first embodiment.

In the walking toy 1 according to the present modification, the projections 56 of the motion members 50 are formed so as to extend from the torso cooperation parts 52 of the motion members 50 toward the inside in the left-right direction. Along with this, the inside walls, in which the grooves 17 are formed, are arranged at the insides of the corresponding motion members 50 in the left-right direction, that is, at the insides of the corresponding rod openings 18. As a result, the torso 10 can be formed smaller in width.

Further, in the present modification, the grooves 17 are arranged upward from the crank member 60. In particular, in the present modification, as will be understood from the path "f" of the point F corresponding to the projections 56 (see FIG. 13), the grooves 17 extend substantially in parallel with the axial direction of the torso 10 (vertical direction) upward at the center of the crank member 60 when in a state where the torso 10 is standing upright.

However, the shapes of the grooves 17 are not limited to the shapes in the above first embodiment and modification. Therefore, the grooves 17 can be made various shapes. However, the grooves 17 are preferably formed in line shapes, for example, straight line shapes, arc shapes, wave shapes, etc., so that the projections 56 of the motion members 50 move back and forth corresponding to rotation of the crank member 60. Further, the grooves 17 are preferably formed so that the torso 10 forms an angle with the walking surface when in a state where it is standing upright with respect to the walking surface. Note that, depending on the shapes of the grooves 17, the directions of the motion members 50 in the different moving states will differ, and accordingly the relationship between the positions of the projections 56 in the grooves 17 in the different moving states and the rotational phase of the crank member 60 will differ.

Further, in the above first embodiment, the grooves 17 are formed at the torso 10, and the projections 56 guided by the grooves 17 are formed at the motion members 50. However, as long as the torso cooperation parts 52 of the motion members 50 can be guided with respect to the torso 10, instead of these grooves 17 and projections 56, other guide mechanisms may also be provided. Therefore, for example, grooves may be formed at the motion members 50 and projections guided by the grooves may be formed at the torso 10.

Figure 14A:
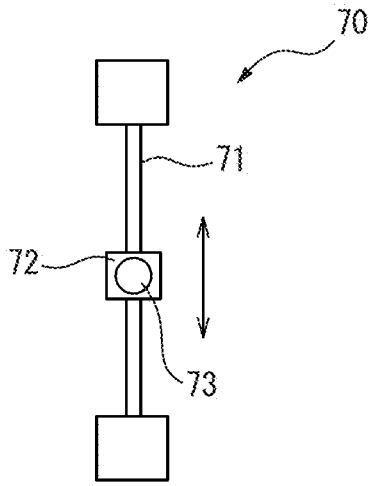
FIGS. 14A and 14B are views schematically showing an example of a guide mechanism.
Figure 14B:
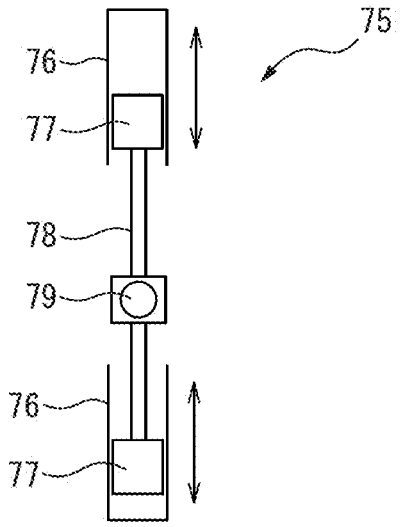

FIGS. 14A and 14B are views schematically showing examples of the guide mechanism. The guide mechanism 70 shown in FIG. 14A is provided with a slide bar 71 connected to the torso 10 and a slider 72 sliding along this slide bar 71. At the slider 72, a cylindrical shaped projection 73 is formed. This cylindrically shaped projection 73 fits in a cylindrically shaped opening formed in the torso cooperation part 52 of the motion member 50. As a result, the torso cooperation part 52 of the motion member 50 is guided along the slide bar 71 provided at the torso 10.

The guide mechanism 75 shown in FIG. 14B is provided with two cylinders 76 formed at the torso 10 and having the same axes, two pistons 77 sliding in these two cylinders 76, and a connecting member 78 connecting these pistons 77. The connecting member 78 moves along the axes of the cylinders 76. At the connecting member 78, a cylindrically shaped projection 79 is formed. This cylindrically shaped projection 79 fits in a cylindrically shaped opening formed in the torso cooperation part 52 of the motion member 50. As a result, the torso cooperation part 52 of motion member 50 is guided along the axes of the cylinders 76 provided at the torso 10.

Furthermore, as long as the torso cooperation part 52 of the motion member 50 can function as a point of support, instead of the groove 17 and the projection 56 or instead of the above guide mechanism, another support point mechanism may be provided. Alternatively, as long as the range of possible movement of the torso cooperation part 52 of the motion member 50 with respect to the torso 10 can be limited, instead of the groove 17 and the projection 56 or instead of the guide mechanism, another movement limiting mechanism may also be provided. Such support point mechanism or the movement limiting mechanism includes, for example, a simple structure mechanical link mechanism, etc. Specifically, it may be considered that one end part of a link member with the other end part pivotably connected to the torso 10 is pivotably connected to the torso cooperation part 52 of the motion member 50.

Figure 15:
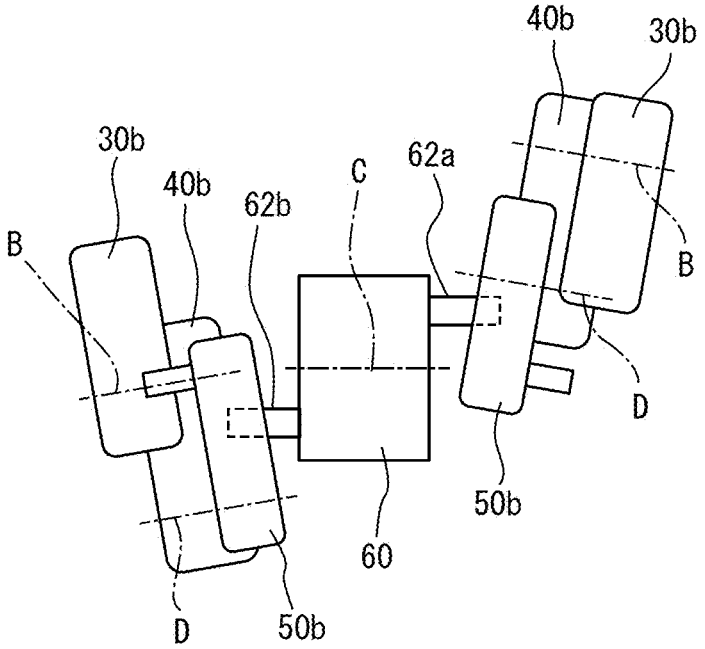
FIG. 15 is a schematic top view of the walking toy in which the torso is omitted.

Further, in the above embodiment, the pivot axis A of the upper leg member 30 with respect to the torso 10, the pivot axis B of the lower leg member 40 with respect to the upper leg member 30, and the pivot axis D of the motion member 50 with respect to the lower leg member 40 are parallel with the rotational axis C of the crank member 60. However, these need not necessarily be parallel. For example, as shown in FIG. 15 of the schematic top view of the walking toy in which the torso is omitted, the pivot axis A of the upper leg member 30, the pivot axis B of the lower leg member 40, and the pivot axis D of the motion member 50 may have angles with respect to the rotational axis C of the crank member 60. In this case as well, the rotational axis C of the crank member 60 extends perpendicular to the vertical surface including the advancing direction.

Second Embodiment

Next, referring to FIGS. 16 to 18A to 18C, a walking toy 1 according to a second embodiment will be explained. Below, the explanation will be given focused on parts different from the walking toy according to the first embodiment.

Figure 16:
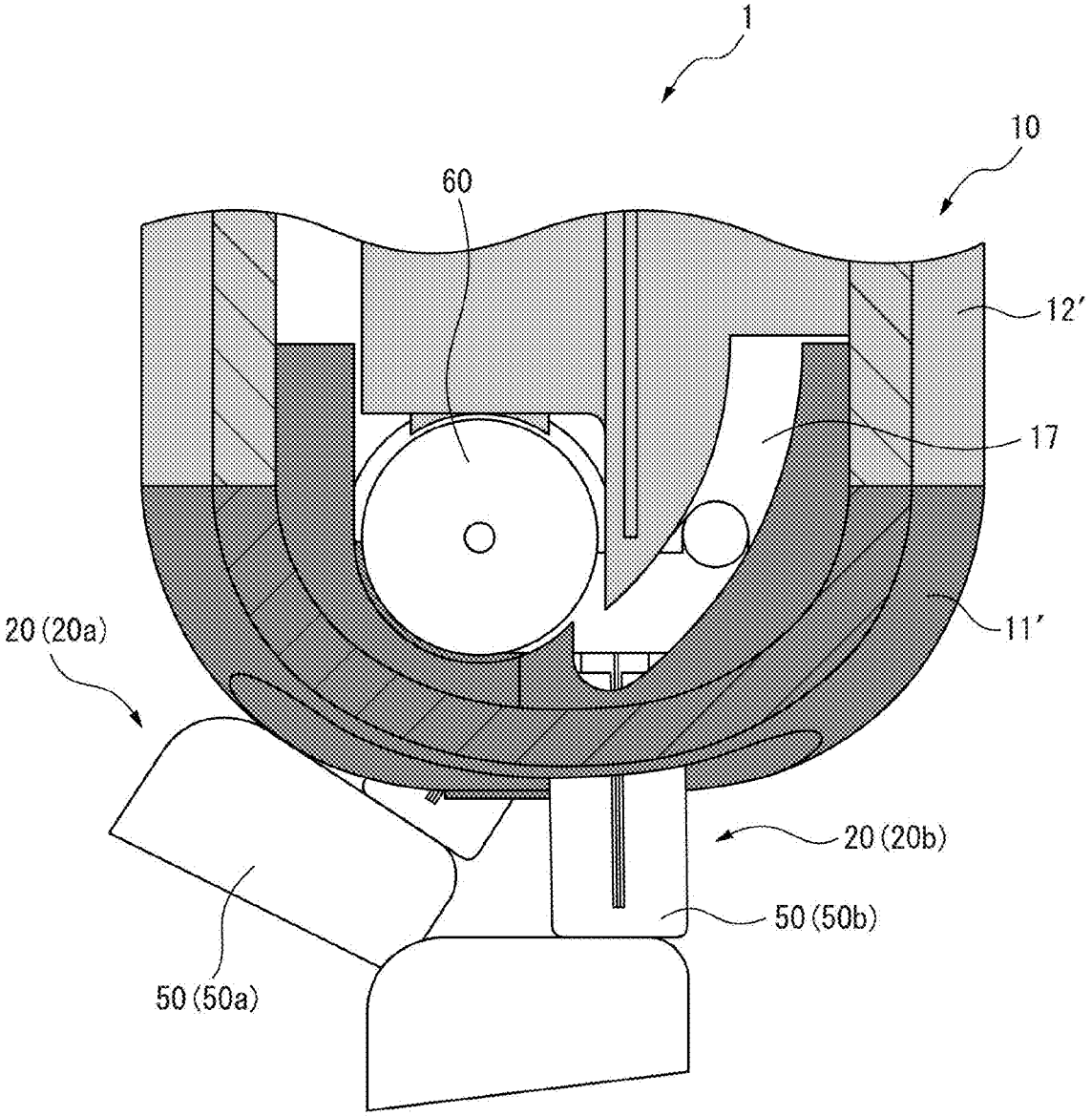
FIG. 16 is a cross-sectional side view of a walking toy according to a second embodiment.
Figure 17:
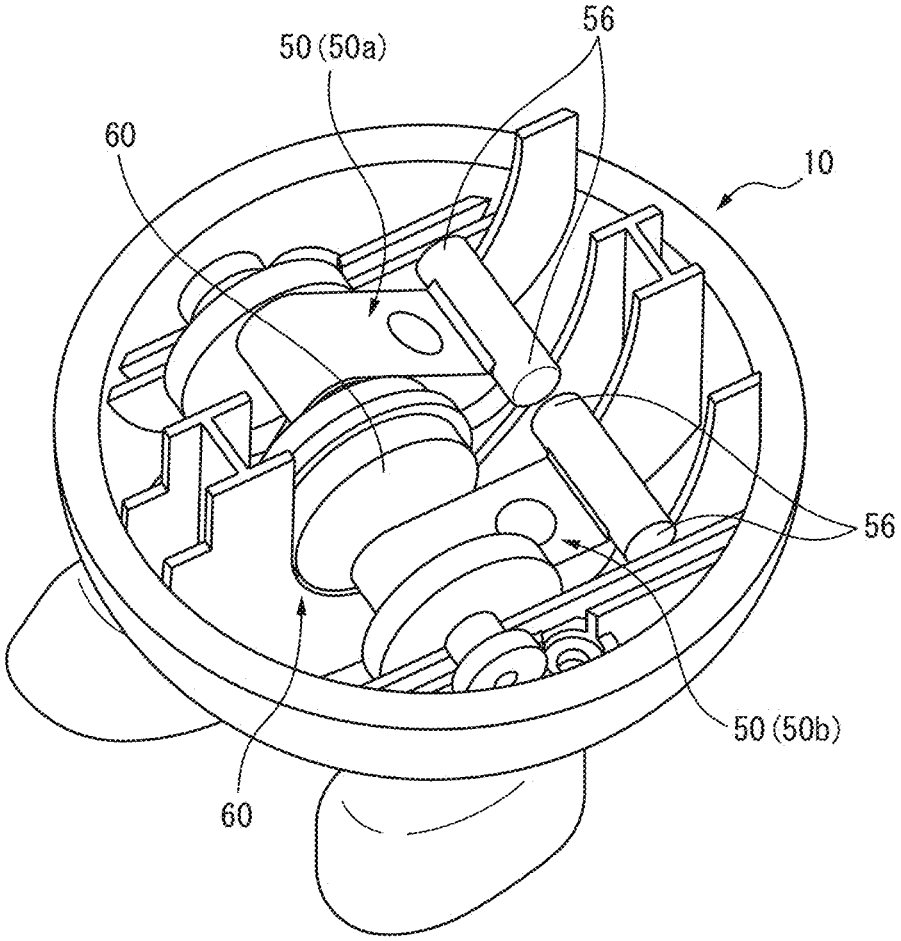
FIG. 17 is a perspective view of the walking toy in which part of the torso is omitted.
Figure 18A:
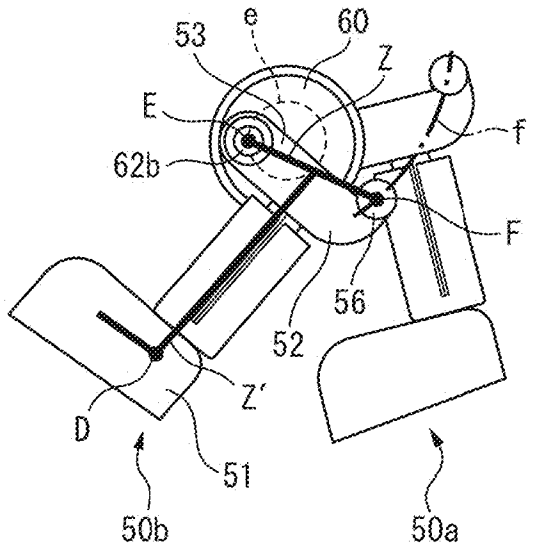
FIGS. 18A to 18C are side views of the walking toy in which the torso is omitted.
Figure 18B:
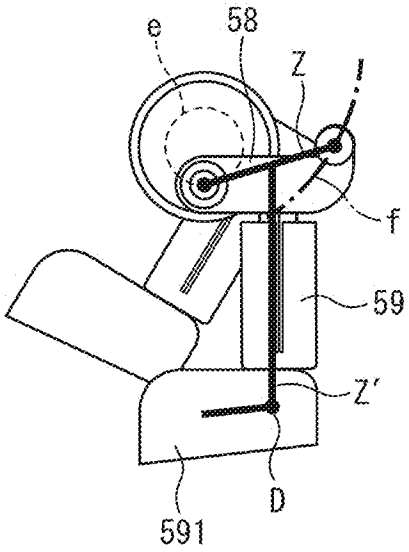
Figure 18C:
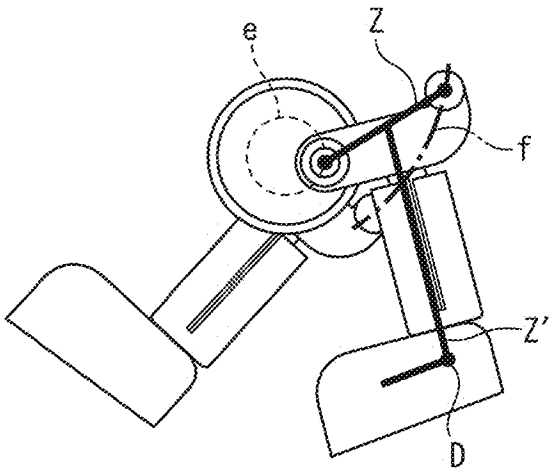

FIG. 16 is a cross-sectional side view of the walking toy 1 according to the second embodiment, FIG. 17 is a perspective view of the walking toy 1 in which part of the torso 10 is omitted, and FIGS. 18A to 18C are side view of the walking toy 1 in which the torso 10 is omitted.

As shown in FIGS. 16 to 18C, the walking toy 1 of the present embodiment is provided, similarly to the walking toy in the first embodiment, with a torso 10, a pair of legs 20, and a crank member 60.

In the present embodiment, the torso 10 has a bottom side half 11' and a top side half 12'. These halves 11', 12' are assembled with each other whereby the torso is formed. The grooves 17 are formed between these bottom side half 11' and top side half 12'. In particular, in the present embodiment, a pair of grooves 17 of the same shapes are provided at the both sides of the legs 20.

Further, in the present embodiment, the legs 20 do not have the upper leg members and lower leg members, and have only motion members 50. The motion members 50 according to the present embodiment are provided with connecting parts 58 and extension parts 59 extending from the connecting parts 58 to the outside. In particular, in the present embodiment, the motion members 50 are configured so that the connecting parts 58 and the extension parts 59 has substantially a T-shape. The connecting parts 58 have torso cooperation parts 52 at one of the end parts thereof and have eccentric shaft connecting parts 53 at the other of the end parts thereof. Further, the extension parts 59 have action parts 51 at their front end parts. Therefore, the motion members 50 are respectively provided with action parts 51, torso cooperation parts 52, and eccentric shaft connecting parts 53.

In the present embodiment, at the front ends of the extension parts 59, foot parts 591 corresponding to feet are provided. The foot parts 591 have contact surfaces which contact the walking surface when the walking toy 1 is walking in the same way as the foot parts of the first embodiment. Therefore, the action parts 51 positioned at the front end parts of the extension parts 59 contact the walking surface when the legs 20 having the action parts 51 contact the walking surface.

The eccentric shaft connecting parts 53 of the motion members 50 are pivotably connected to the corresponding crank eccentric shafts 62. Therefore, the eccentric shaft connecting parts 53 are connected to the crank eccentric shafts 62 so that the motion members 50 can pivot about the axes of the crank eccentric shafts 62.

At the torso cooperation parts 52 of the motion members 50, columnar shaped parts are formed. The two ends of the columnar shaped parts constitute projections 56 projecting to the left-right direction from the connecting parts 58. Therefore, in the present embodiment, the torso cooperation parts 52 have two projections 56 projecting out in opposite directions from each other. These projections 56 are housed in the grooves 17 formed in the torso 10 so that they slide in the grooves 17.

The thus configured walking toy 1 according to the second embodiment also walks by the legs 20 by the user pushing, by hand, etc., the torso 10 forward to make the torso 10 move forward in the state with the contact surface of at least one of the legs 20 contacting the walking surface. FIGS. 18A to 18C show different walking states of the walking toy 1. Note that, in FIGS. 18A to 18C as well, the point D is shown for convenience in the same way as FIGS. 9 to 11, but in the present embodiment, the point D does not function as a pivot axis.

FIG. 18A shows the walking state of the walking toy 1 when the left motion member 50*b* of the left leg 20*b*, which was not contacting the ground, contacts the ground. At this time, an upward force and rearward force are applied to the action part 51 of the left motion member 50*b*. Further, the projection 56 (point F) of the left motion member 50*b* functions as a point of support, therefore a rotational force is applied to the left crank eccentric shaft 62*b* (point E) and thus the crank member 60 rotates counterclockwise.

FIG. 18B shows the walking state of the walking toy 1 when the right motion member 50*a* of the right leg 20*a* not contacting the walking surface moves forward from the left motion member 50*b* of the left leg 20*b* contacting the walking surface. Further, FIG. 18C shows the walking state of the walking toy 1 when the right motion member 50*a* of the right leg 20*a*, which did not contact the walking surface, contacts the walking surface. In the walking states shown in FIGS. 18B to 18C as well, an upward force and rearward force are applied from the walking surface to the action part 51 of the left motion member 50*b*. Further, by the projection 56 of the left motion member 50*b* (point F) functioning as a point of support, a rotational force is applied to the left crank eccentric shaft 62*b* (point E) and thus the crank member 60 rotates counterclockwise.

Then, an operation similar to the operation shown in FIGS. 18A to 18C is performed in the right leg 20*a*. Further, such an operation is alternately repeated at the left and right whereby the walking toy 1 walks on the walking surface. Therefore, in the walking toy 1 according to the present embodiment as well, in a similar way to the walking toy according to the first embodiment, the walking toy 1 can be made to continuously walk. Therefore, according to the present embodiment, using the guide mechanisms, movement limiting mechanisms, or support point mechanisms which is formed from the projections 56 of the motion members 50 and the grooves 17 of the torso 10, that is, using simple mechanisms, it is possible to make the crank member 60 stably rotate and accordingly possible to make the walking toy 1 stably walk by a fewer number of parts than the first embodiment.

Note that, in the above second embodiment, the motion members 50 are formed so as to have T-shapes, but they may also be formed so as to have shapes different from T-shapes. Therefore, for example, the motion members 50 may be formed in straight shapes in similarly to the first embodiment. Further, conversely, the motion members according to the first embodiment may be formed in T-shapes similarly to the motion members according to the second embodiment.

Third Embodiment

Next, referring to FIGS. 19 to 20, a walking toy 1 according to a third embodiment will be explained. Below, the explanation will be given focused on parts different from the walking toy according to the first embodiment.

Figure 19:
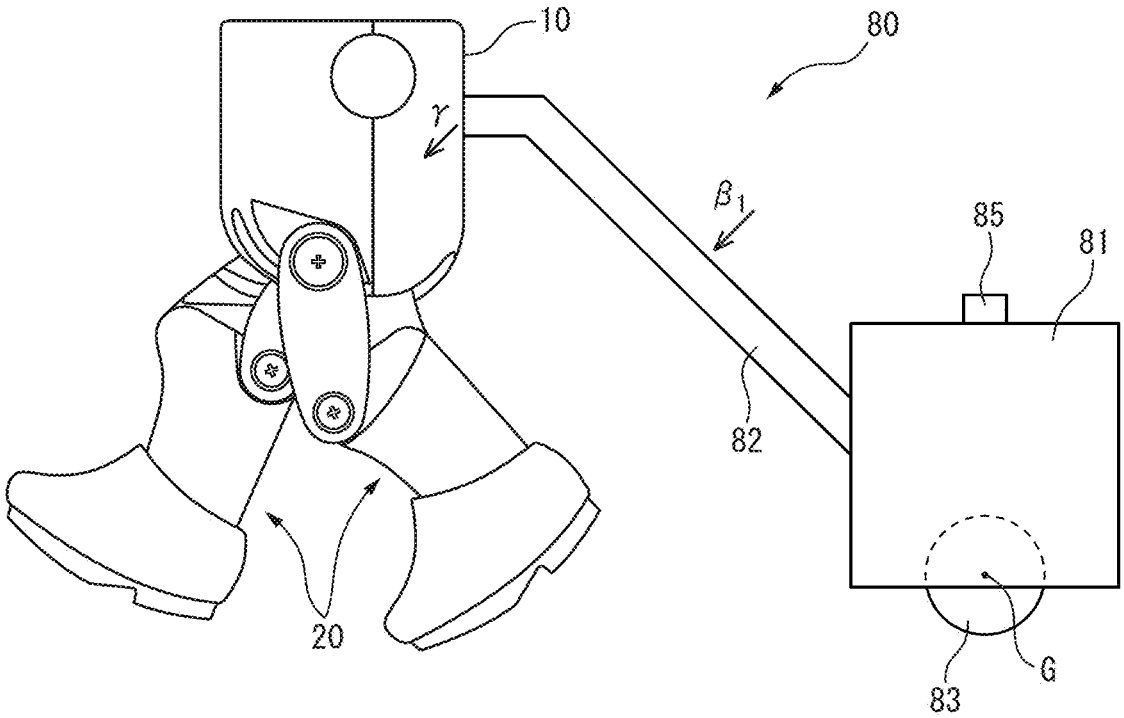
FIG. 19 is a side view schematically showing a walking toy according to a third embodiment.
Figure 20:
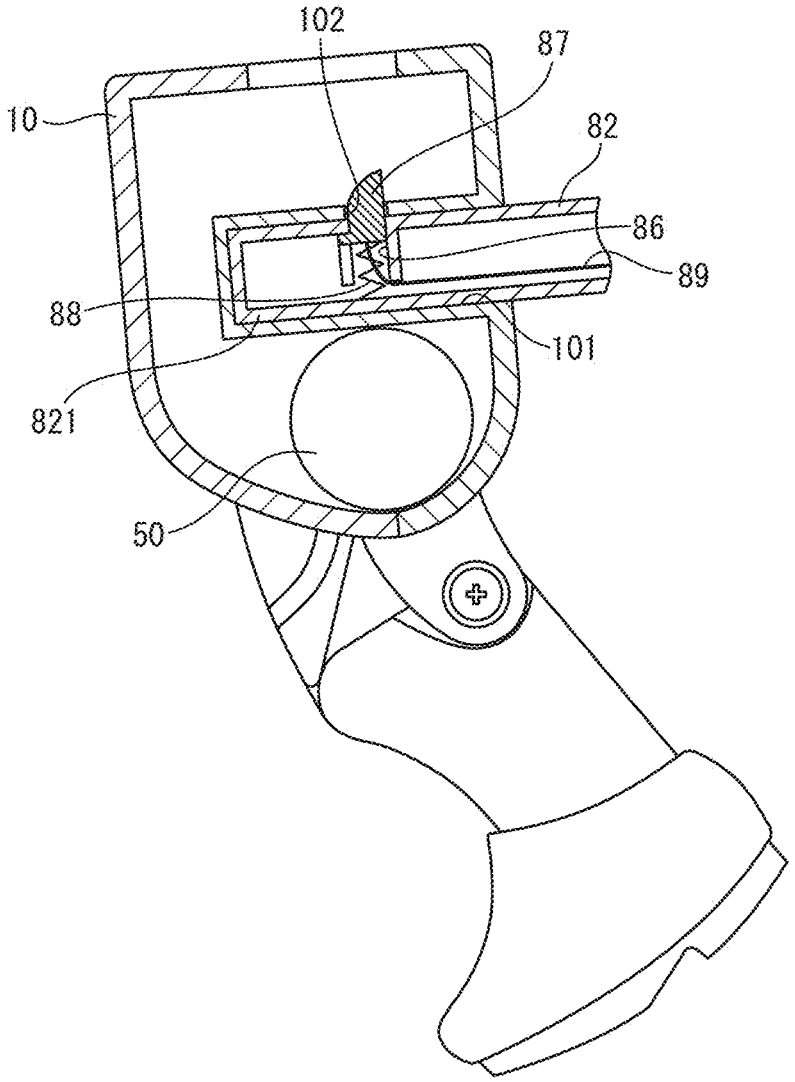
FIG. 20 is a schematic cross-sectional view of the vicinity of the torso, showing the state where an upper end part of the arm is attached to the torso.

FIG. 19 is a side view schematically showing the walking toy 1 according to the third embodiment. As shown in FIG. 19, the walking toy 1 according to the present embodiment is provided with a walking aid 80 attached to the torso 10, in addition to the walking toy according to the first embodiment or the second embodiment provided with the torso 10, legs 20, and crank member 60 (below, also referred to as the "doll part").

The walking aid 80 aids the walking motion by the doll part of the walking toy 1. The walking aid 80 is provided with a main body part 81, an arm 82 fixed to the main body part 81 and to be attached to the torso 10, and wheels 83 continuously in contact with the walking surface.

The main body part 81 is formed as a hollow housing. In the example shown in FIG. 19, the main body part 81 has a box shape, but it may have any shape. At the top surface of the main body part 81, a switch 85 for operating a locking part provided at the arm 82, is provided. Note that, as long as being possible to operate the locking part, the switch 85 may be arranged anywhere at the walking aid 80.

The arm 82 is formed in a hollow shape. At the bottom end part, it is fixed to the front of the main body part 81. Further, the arm 82 is attached to the rear side of the torso 10 at its top end part. In the present embodiment, the attachment position of the arm 82 to the torso 10 is higher than the position fixed to the main body part 81. Therefore, the arm 82 is attached to the torso 10 so as to be slanted upward toward the front, that is, so as to be slanted upward from the position fixed to the main body part 81 toward the position attached to the torso 10.

Further, in the present embodiment, the top end part of the arm 82 is detachably attached to the rear side of the torso 10 (back side). As a result, the walking aid 80 is detachably attached to the torso. FIG. 20 is a schematic cross-sectional view of the vicinity of the torso 10 showing the state where the top end part of the arm 82 is attached to the torso 10. As shown in FIG. 20, at the top end part of the arm 82, an attachment part 821 to be attached to a receiving part 101 of the torso 10 is formed. The attachment part 821 is, for example, a bar part formed into an angular columnar shape. On the other hand, the receiving part 101 to which the attachment part 821 is attached is, for example, formed at the rear surface of the torso 10 as a receiving hole having a shape complementary to the bar part having an angular columnar shape. Therefore, in the present embodiment, the attachment part 821 is attached to the receiving part 101 by the bar part of the attachment part 821 being inserted into the receiving hole of the receiving part 101.

Further, at the top part of the attachment part 821, a sliding opening 86 is formed. Inside this sliding opening 86, a locking part 87 sliding along the sliding opening 86 is arranged. In the present embodiment, the sliding opening 86 is formed at the top surface of the attachment part 821. The locking part 87 can slide between a projecting state where it projects upward from the sliding opening 86 of the attachment part 821 and a stored state where it is stored in the sliding opening 86. The locking part 87 is biased upward by an elastic member 88. Therefore, the locking part 87 is maintained in the projecting state when force is not applied from the outside.

At the receiving part 101, a locking hole 102 is formed at a position facing the sliding opening 86 when the attachment part 821 is attached to the receiving part 101. Therefore, when the attachment part 821 is attached to the receiving part 101 and the locking part 87 is in the projecting state, the locking part 87 is locked in the locking hole 102 and accordingly the attachment part 821 is locked in the receiving part 101.

Further, at the bottom surface of the locking part 87, a strap 89 is provided. This strap 89 is passed through the inside of the hollow arm 82 and connected to the switch 85. In the present embodiment, when the switch 85 is operated by the user, the locking part 87 slides against the biasing force of the elastic member 88 from the projecting state to the stored state. As a result, when the switch is operated, the lock of the locking part 87 in the locking hole 102 is released and, accordingly, the lock of the attachment part 821 in the receiving part 101 is released.

The wheels 83 continuously contact the walking surface at positions different from the legs 20 while walking motion by the legs 20 is being performed. In the present embodiment, the walking aid 80 is provided with only one set of wheels rotatably attached to the main body part 81. In particular, in the present embodiment, these wheels rotate about one axis G substantially perpendicular to the front-rear direction.

The walking aid 80 is formed so that when attached to the torso 10, the torso 10 is held at a specific angle with respect to the walking surface. In particular, in the present embodiment, the walking aid 80 is formed so that the torso 10 is held in a state standing upright with respect to the walking surface (that is, a state in which the axis of the torso 10 extends in the vertical direction).

The thus configured walking aid 80 constantly contacts the walking surface by the wheels 83. Here, at the doll part, usually only one leg contacts the walking surface during walking. In this case, sometimes stumbling will occur due to staggering tilting to the front, rear, left, or right direction. Further, for the doll part to walk, frictional force must be generated between the leg contacting the walking surface and the walking surface, but if staggering occurs such as described above, there is a possibility that the frictional force will be insufficient. As opposed to this, the wheels 83 are constantly in contact with the ground, therefore such staggering can be kept from occurring.

Note that, in the above embodiment, wheels 83 are used as auxiliary contact parts continuously contacting the walking surface. However, as long as being able to continuously contact the walking surface, auxiliary contact parts other than the wheels 83 may also be used. Such auxiliary contact parts, for example, may also be flat shaped contact members. Alternatively, they may be the walking toy according to the first embodiment or the second embodiment provided with the torso, legs, and crank member.

Further, in the above embodiment, the walking aid 80 is attached to the rear side of the torso 10. However, the walking aid 80 may also be attached to a portion different from the rear side of the torso 10. For example, it may be attached to the front side of the torso 10.

Furthermore, in the above embodiment, the arm 82 slants upward from the position fixed to the main body part 81 to the position attached to the torso 10. Therefore, due to the gravitational force applied to the arm 82, the arm 82 is acted on by a moment centered on the wheels 83 of the main body part 81. Further, if a forward downward force $\beta_1$ is applied to the arm 82 from the outside, due to that force as well, the arm 82 is acted on by a moment centered on the wheels 83 of the main body part 81. As a result, at the position of attachment of the arm 82 to the torso 10, a forward downward force $\gamma$ is applied to the torso 10. In other words, in the present embodiment, it can be said that the walking aid 80 is attached to the torso 10 so that a forward and downward force are applied to the torso 10 when a forward and downward force is applied to the walking aid 80. As a result, when the torso 10 moves forward due to application of the forward force $\beta$ to the arm 82, the frictional force generated between the contact surface of the leg 20 contacting the walking surface and the walking surface becomes larger. For this reason, the leg 20 is kept from sliding on the walking surface in a forward orientation when forward force is applied to the torso 10.

Figure 21:
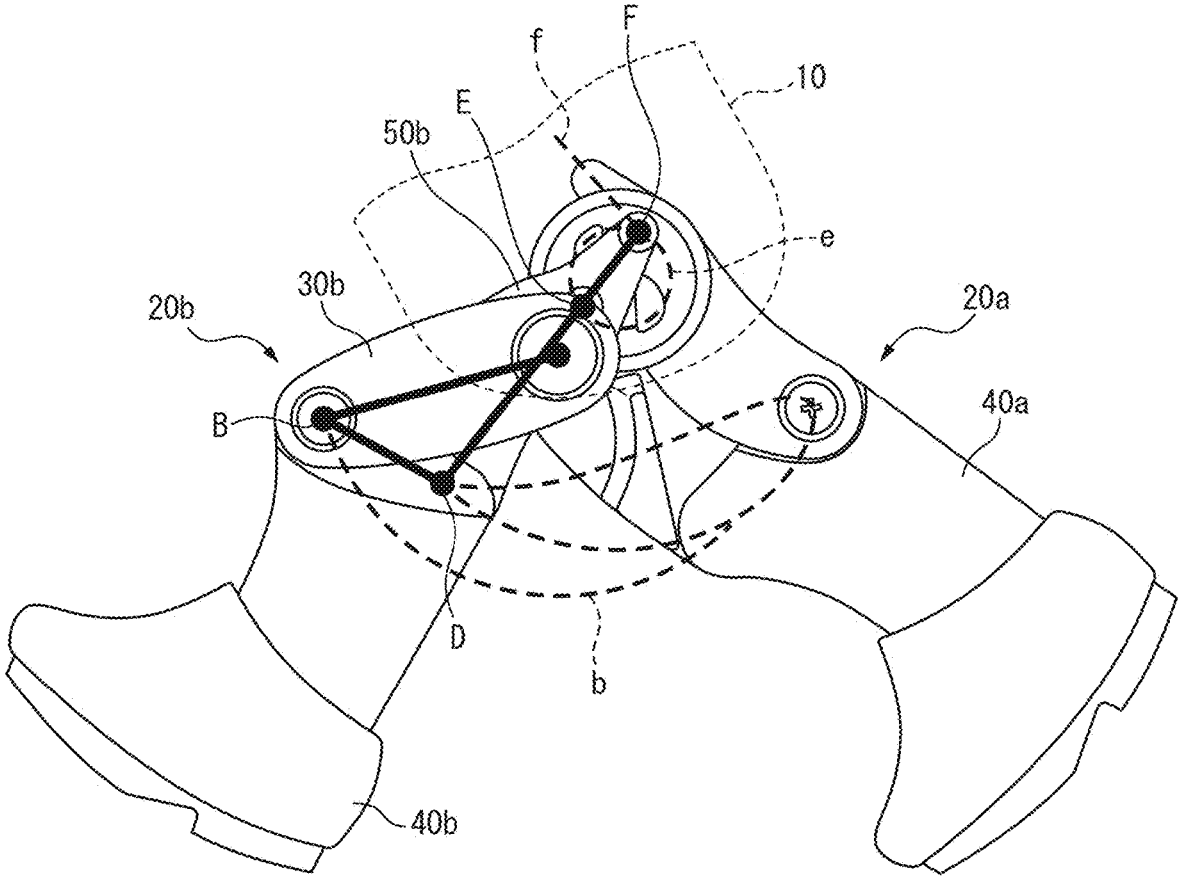
FIG. 21 is a side view showing a walking state of the walking toy, in the state where the torso is slanted in a forward orientation.

Next, the relationship between the slant of the torso 10 with respect to the walking surface and walking will be explained. FIG. 21 is a side view showing the walking state of the walking toy 1 when the torso 10 is in a state slanted to a forward orientation. In the state shown in FIG. 21, the left leg 20*b* and the left lower leg member 40*b* are positioned at the forward most position (position lifted up the most). Further, in this state, the left leg 20*b*, which had up to then moved forward without contacting the walking surface, contacts the walking surface. Therefore, if tilting the torso 10 with respect to the walking surface further to the forward orientation, the left leg 20*b* which had been moving forward without contacting the walking surface contacts the walking surface before reaching the forward most position. Further, if the left leg 20*b* contacts the walking surface, a relatively rearward force is applied to the left leg 20*b* when a forward force is applied to the torso 10. The left leg 20*b* is before reaching the forward most position, therefore if rearward force is applied to the left leg 20*b*, force is applied to the crank member 60 in the opposite rotational direction. As a result, the walking toy 1 is no longer able to walk further. Therefore, in this case, the walking toy 1 cannot continuously perform walking motion. Conversely speaking, if the angle of the torso 10 with respect to the walking surface is an angle in a certain range larger than the angle shown in FIG. 21 (right angle side), the lower leg members 40 of the legs 20, which moved forward in the state separated from the walking surface, contact the walking surface after reaching the forward most positions. Therefore, in this case, the walking toy 1 can continuously perform walking motion.

Further, if the torso 10 is slanted in a rearward orientation with respect to the walking surface, if the slant angle becomes too large over equal to or greater than a certain specific angle, the walking toy 1 may reach a state where the contact surfaces of the lower leg members 40 extend substantially vertical. If reaching such a state, even if making the torso 10 move forward, a rearward force can no longer be applied to the lower leg members 40. As a result, the walking toy 1 can no longer continuously perform walking motion. Therefore, even if the torso 10 slants too much in the rearward orientation, the walking toy 1 cannot continuously perform walking motion. Therefore, in the walking toy 1, walking motion is continuously performed if the angle of the axis of the torso 10 with respect to the walking surface is within a certain range.

Here, in the present embodiment, the walking aid 80 holds the torso 10 of the doll part so that the angle of the axis of the torso 10 with respect to the walking surface is substantially a right angle. Therefore, the angle of the axis of the torso 10 with respect to the walking surface is an angle within the above-mentioned certain range. For this reason, the walking toy 1 having the walking aid 80 according to the present embodiment can continuously perform walking motion. Note that, the walking aid 80 may hold the torso 10 so that the axis of the torso 10 has an angle with respect to the walking surface different from a right angle if the angle of the axis of the torso 10 with respect to the walking surface is maintained in the above-mentioned certain range. The walking aid 80 may also be configured so as to enable change of the angle of the axis of the torso 10 with respect to the walking surface in the above-mentioned certain range.

Note that, in the present embodiment, the arm 82 is attached to the torso 10, but it may also be attached to a member of the upper body part different from the torso 10, for example, the head member or the arm members. Further, in the present embodiment, the arm 82 and main body part 81 of the walking aid 80 are configured as members separate from the torso 10. However, the walking aid 80 may also be formed integrally with the torso 10. In this case, the walking aid 80 cannot be detached from the torso 10.

Further, in the above second embodiment, as the doll part of the walking toy 1, the walking toy according to the above first embodiment is used. However, as the doll part, a doll part of a configuration different from the walking toy according to the above first embodiment may be used. However, even in this case, the doll part is configured so that if the angle of the torso with respect to the walking surface in the front-rear direction is within a certain range, the walking motion is continuously performed. Alternatively, the doll part is configured so that if the angle of the axis of the torso with respect to the walking surface in the front-rear direction is within a constant range, the lower leg member 40 of the leg 20 which had been moved forward in the state separated from the walking surface reaches the forward most position, then contacts the surface.

Figure 22:
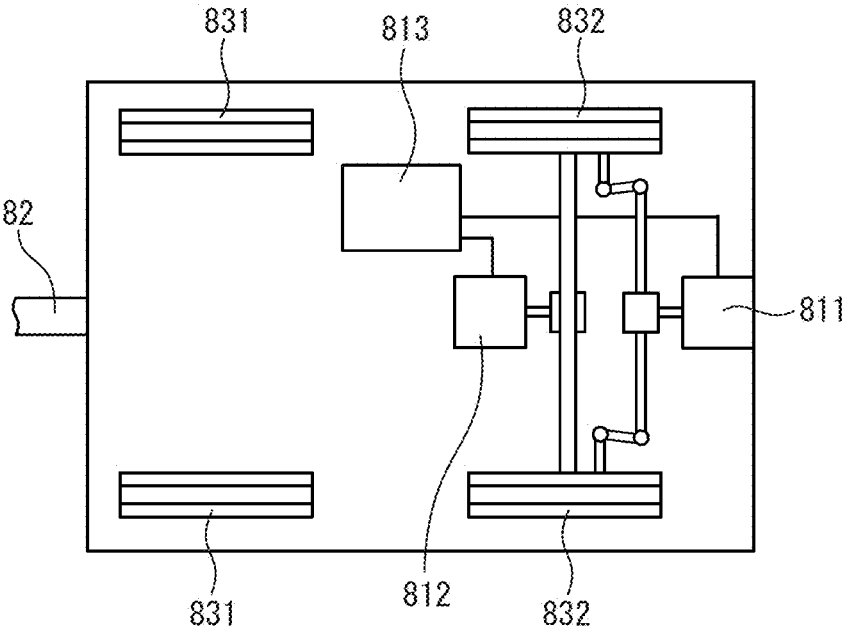
FIG. 22 is a schematic plan view of a main body part of a walking aid according to a modification of the third embodiment.

Further, the walking aid 80 may be provided with motors for driving the wheels 83. FIG. 22 is a schematic plan view of a main body part 81 of a walking aid 80 according to a modification of the third embodiment. As shown in FIG. 22, the walking aid 80 according to the present modification has four wheels 83. Among these, the two front side walls are driven wheels 831, while the two rear side wheels are steering drive wheels 832. The main body part 81 has a steering motor 811, drive motor 812, and electronic control unit 813 connected to these motors 811, 812. The steering drive wheels 832 are steered by the steering motor 811 and are driven by the drive motor 812. The steering motor 811 and the drive motor 812 are controlled by the electronic control unit 813. The electronic control unit 813 may also be provided with a communication device enabling communication with an outside controller. In this case, the steering motor 811 and the drive motor 812 are controlled by the outside controller. Note that, the walking aid 80 may also not have driven wheels 831 and have only steering drive wheels 832. Further, the steering motor 811 may not be provided either. Accordingly, the steering drive wheels 832 may not be steered.

In this way, by the walking aid 80 being provided with motors driving the wheels 83, the walking toy can be made to walk even without the user pushing the torso 10 by his hands.

Fourth Embodiment

Next, referring to FIGS. 23 to 25B, a walking toy 1 according to a fourth embodiment will be explained. Below, the explanation will be given centered on parts different from the walking toy according to the third embodiment.

Figure 23:
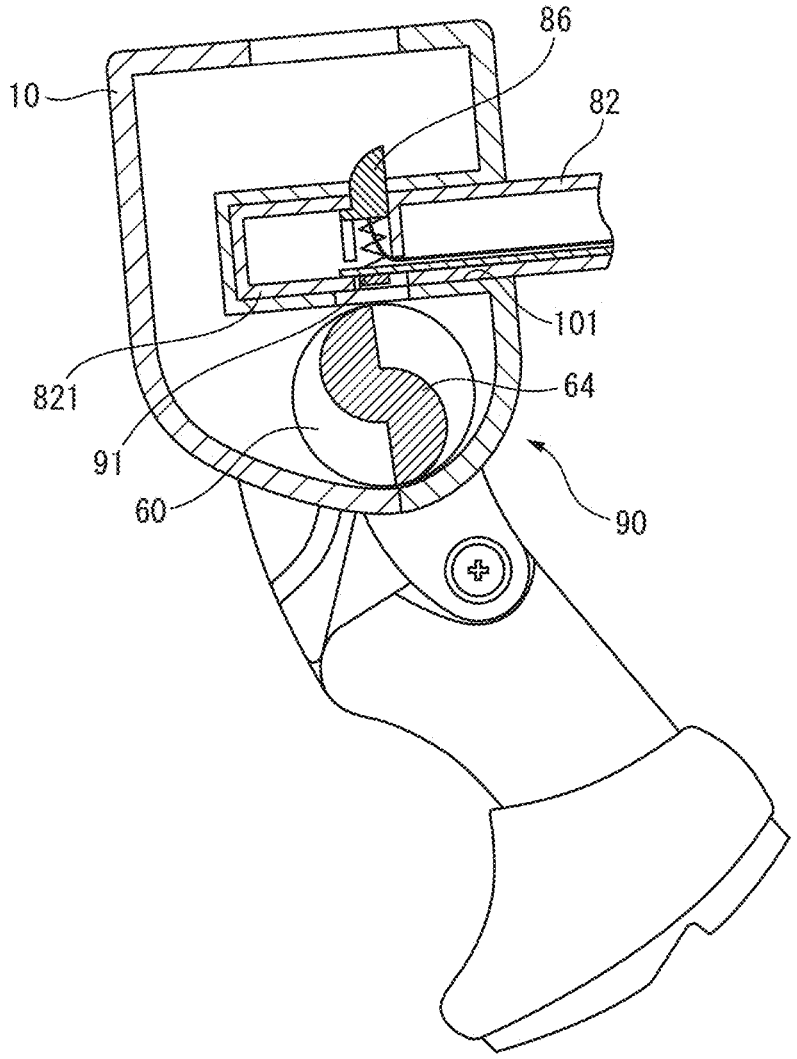
FIG. 23 is a schematic side view of the vicinity of the torso similar to FIG. 20.

FIG. 23 is a schematic side view of the vicinity of the torso 10, similar to FIG. 16. As shown in FIG. 23, the walking toy 1 according to the present embodiment is provided with a phase detector 90 detecting a rotational phase of the crank member 60. The phase detector 90 is provided with a detected part 64 formed at the crank member 60 and a detector 91 arranged so as to face the detected part 64. The output signal of the phase detector 90 is input to a computer (not shown) arranged in the walking toy 1. Alternatively, the output signal of the phase detector 90 may be input through a communicating means to an outside computer. These computers perform processing according to the signal input from the phase detector 90. They are used for processing inside. The detected rotational phase is, for example, used for operating other equipment linked with motion of the legs 20 of the walking toy 1.

Figure 24:
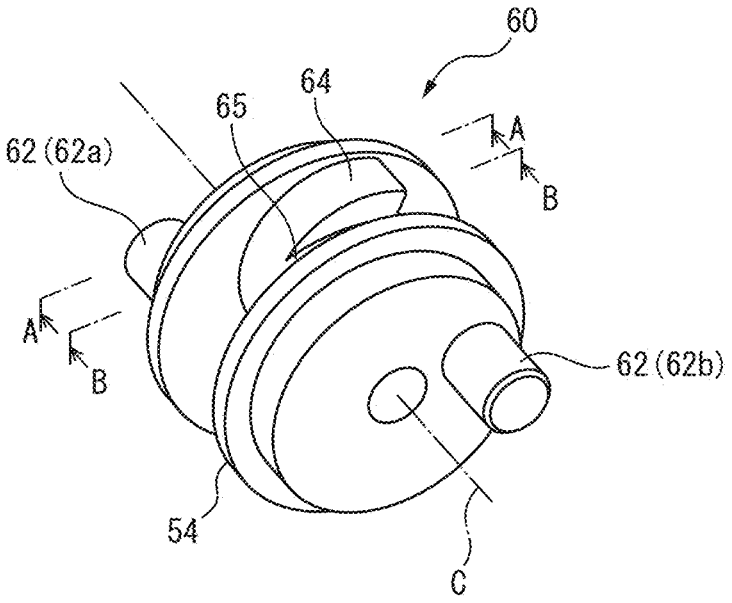
FIG. 24 is a perspective view of a crank member according to a fourth embodiment.
Figure 25A:
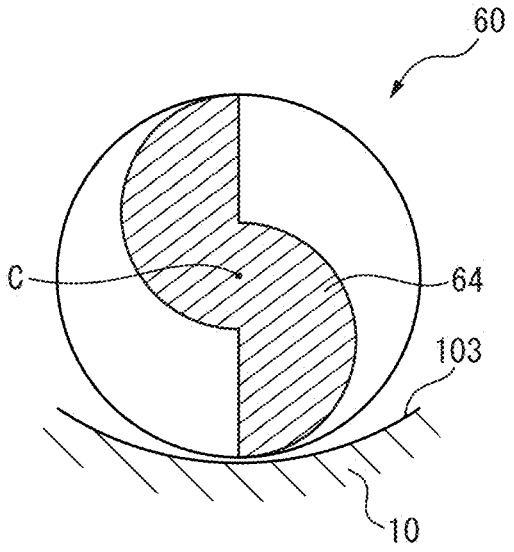
FIGS. 25A and 25B are cross-sectional views of the crank member.
Figure 25B:
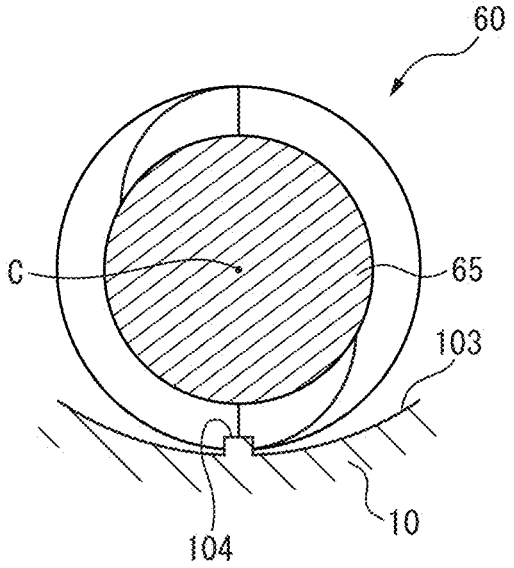

FIG. 24 is a perspective view of a crank member 60 according to the present embodiment. Further, FIG. 25A is a cross-sectional view of the crank member 60 seen along A-A of FIG. 24, while FIG. 25B is a cross-sectional view of the crank member 60 seen along B-B of FIG. 24. In FIGS. 25A and 25B, part of the torso 10 is shown in addition to the crank member 60.

As shown in FIG. 24, the crank member 60 is provided with a pair of disk shaped members 63 arranged at the outsides in the direction of the rotational axis C, and the detected part 64 and spacer 65 provided between the disk shaped members 63. The spacer 65 is arranged adjoining the detected part 64. As shown in FIG. 25A, the detected part 64 is formed by two members with semicircular shaped cross-sections combined with each other eccentrically with respect to the rotational axis C of the crank member 60. Therefore, the detected part 64 is formed so that its outer circumferential surface changes in distance from the rotational axis C in the circumferential direction of the crank member 60. Further, as shown in FIG. 25B, the spacer 65 is formed in a columnar shape so that its outside diameter is smaller than the maximum outside diameter of the detected part 64. Therefore, the spacer 65 has an outer circumferential shape different from the detected part 64.

Further, as shown in FIG. 25B, on the wall surface 103 of the torso 10 facing the spacer 65, a projecting part 104 is provided. This projecting part 104 has a height so as to not reach the outer circumferential surface of the spacer 65. Further, the projecting part 104 has a height so that when the crank member 60 is arranged in the opposite direction vis-a-vis the left and right in the torso 10 and the projecting part 104 faces the detected part 64 of the crank member 60, the projecting part 104 will contact the detected part 64 during rotation of the crank member 60. Therefore, in the present embodiment, the torso 10 is formed so that when the crank member 60 is arranged in the torso 10 in the first direction (correct direction), the torso 10 will not interfere with the outer circumferential surface of either of the detected part 64 and spacer 65 and so that when the crank member 60 is arranged in the torso 10 in the second direction opposite to the first direction (mistaken direction), the torso 10 will interfere with the outer circumferential surface of the detected part 64. As a result, it is possible to prevent the crank member 60 from being arranged in the opposite direction.

Note that, the spacer 65 may be formed so that its outside diameter is larger than the maximum outside diameter of the detected part 64. In this case, when the crank member 60 is arranged in the torso 10 in the first direction, the torso 10 will not interfere with the outer circumferential surface of either of the detected part 64 and spacer 65, and when the crank member 60 is arranged in the torso in the second direction opposite to the first direction, the torso 10 will interfere with the outer circumferential surface of the spacer 65.

In the present embodiment, the detector 91 is arranged at the attachment part 821 of the arm 82. Further, the receiving part 101 is positioned upward from the crank member 60. Therefore, the attachment part 821 is positioned upward from the detected part 64 when attached to the receiving part 101. Further, the detector 91 is arranged at the bottom side of the attachment part 821. Therefore, the detector 91 is arranged at the attachment part 821 so as to face the top surface of the detected part 64 of the crank member 60 when the attachment part 821 is attached to the receiving part 101.

Further, in the present embodiment, the detector 91 is an optical sensor detecting a distance to an object facing the detector 91. The detector 91 is arranged so as to face the detected part 64, therefore outputs a signal corresponding to the distance to the outer circumferential surface of the detected part 64.

Here, as explained above, the attachment part 821 is provided with a locking part 87 at its top side. In the present embodiment, by the detector 91 being arranged at the bottom side of the attachment part 821, the attachment part 821 can be provided with both the locking part 87 and detector 91. Further, when attachment part 821 is attached to the receiving part 101, the detector 91 faces the top surface of the detected part 64 in the torso 10. Therefore, since the detector 91, which is an optical sensor, detects distance in a relatively dark in of the torso 10, it can detect the distance with a high precision. Furthermore, in the present embodiment, the detector 91 is arranged at the bottom side of the attachment part 821. Therefore, compared to the case where the detector 91 is provided at the front end of the attachment part 821, the attachment part 821 can be inserted up to the deep end in the torso 10. As a result, the attachment part 821 can be stably attached to the receiving part 101.

Note that, so long as able to detect the distance to an object facing the detector 91, the detector 91 may be a magnetic sensor, contact type sensor, or other sensor. Further, so long as able to detect a phase of the crank member 60, the phase detector 90 may also be configured as a rotary pulse detection sensor outputting a pulse signal each time the crank member 60 rotates by a certain angle, or other phase detector.

Further, in the present embodiment, the detector 91 is provided at the attachment part 821 of the walking aid 80. However, the detector 91 may, for example, also be arranged in the torso 10, or may also be provided at a part separate from the walking aid 80.

Specifically, for example, the front side of the torso 10 (ventral side) may be provided with a receiving part different from the receiving part 101 and an attachment part having a detector may be attached to that receiving part. In this case, the attachment member may have a communication device able to send output from the detector to an outside device. By providing a receiving part, different from the receiving part 101 for attaching the walking aid 80, at the torso 10 in opposite directions from each other in this way, it is possible to simultaneously attach the separate walking aid 80 and attachment member having a detector.

Further, in the above embodiment, the projecting part 104 is provided on the wall surface 103 of the torso 10 at a position facing the spacer 65. However, the projecting part 104 may also be provided on the wall surface 103 at a position facing the detected part 64. In this case, the spacer 65 has to have a maximum outside diameter larger than the maximum outside diameter of the detected part 64.

Above, preferred embodiments were explained, but the present disclosure is not limited to these embodiments. They can be corrected and changed in various ways within the language of the claims.

The invention claimed is:

1. A walking toy having: an upper body part including a torso; and two legs connected to the torso, in which if the torso is made to move forward in the state where a contact surface of at least one leg contacts a walking surface, walking motion is performed by the legs, the walking toy comprising:

a crank member rotatably supported in the torso and having a pair of crank eccentric shafts positioned eccentrically from a rotational axis of the crank member, wherein the crank eccentric shafts are arranged so as to have opposite phases from each other with respect to the rotational axis, each of the legs has a motion member giving rotational force to the crank member when the torso moves forward, each of the motion members has an eccentric shaft connecting part pivotably connected to the corresponding crank eccentric shaft, a torso cooperation part cooperating with the torso, and an action part on which force received from the walking surface act, grooves are formed at one of the torso cooperation parts of the motion members and the torso, and projections sliding in the grooves and guided by the grooves are formed at the other of the torso cooperation parts and the torso, the grooves are configured so that the projections can reciprocate in the grooves corresponding to rotational motion of the crank member, and if the torso is made to move forward to make the action part of the motion member of the one leg contacting the walking surface move rearward relative to the torso, the motion member of the one leg moves to thereby impart rotational force to the crank member by the motion member due to the projection being limited in movement in the groove and, the other leg is made to move forward in the state separated from the walking surface due to rotation of the crank member and then is made to contact the walking surface.

2. The walking toy according to claim 1, wherein each of the legs further has an upper leg member and a lower leg member, the upper part of the upper leg member is pivotably connected to the torso and the lower leg member is pivotably connected to a lower part of the upper leg member, and the action part of each of the motion members is connected to the corresponding lower leg member at a position different from the connecting part to the upper leg members.

3. The walking toy according to claim 2, wherein the action part of each of the motion members is pivotably connected to the corresponding lower leg member at a positions rearward from the connecting part to the upper leg members.

4. The walking toy according to claim 1, wherein the motion members are straight rods, and the eccentric shaft connecting part is positioned between the torso cooperation part and the action part.

5. The walking toy according to claim 1, wherein the contact surface of each of the legs is formed in an arc shape sticking out toward the walking surface in the front-rear direction.

6. The walking toy according to claim 1, wherein the walking toy further comprises a walking aid attached to the upper body part, and the walking aid has an auxiliary contact part continuously contacting the walking surface at a position different from the legs while the walking motion is being performed.

7. The walking toy according to claim 6, wherein the auxiliary contact parts are wheels.

8. The walking toy according to claim 6, wherein the torso, the legs, and the crank member are configured so that the walking motion is continuously performed when the angle, in the front-rear direction, of the axis of the torso with respect to the walking surface is within a certain range, and the walking aid holds the torso so that the angle of the axis of the torso with respect to the walking surface is maintained within the certain range.

9. The walking toy according to claim 6, wherein the torso, the legs, and the crank member are configured so that the lower leg member of the other leg which had been moved forward in a state separated from the walking surface contacts the ground after reaching the forward most position, if the angle, in the front-rear direction, of the axis of the torso with respect to the walking surface is within a certain range, and the walking aid holds the torso so that the angle of the axis of the torso with respect to the walking surface is maintained within the certain range.

10. The walking toy according to claim 6, wherein the walking aid has an attachment part and the upper body part has a receiving part, and the walking aid is detachably attached with respect to the upper body part by the attachment part being detachably attached with respect to the receiving part.

11. The walking toy according to claim 10, further comprising a phase detector detecting a rotational phase of the crank member, wherein the phase detector has a detected part provided at the crank member and a detector arranged at the attachment part so as to face the detected part, the detected part is formed so that an outer circumferential surface thereof changes in distance from the rotational axis of the crank member in the circumferential direction of the crank member, and the detector outputs a signal corresponding to the distance to the outer circumferential surface of the detected part.

12. The walking toy according to claim 11, wherein the detector is an optical sensor detecting a distance to an object, the receiving part is a receiving hole formed in the torso, the attachment part is configured so as to be inserted in the receiving hole, and the detector is arranged at the attachment part so that the detector faces the detected part in the torso when the attachment part is inserted into the receiving part.

13. A walking toy having: an upper body part including a torso: and two legs connected to the torso, in which if the torso is made to move forward in the state where a contact surface of at least one leg contacts a walking surface, walking motion is performed by the legs, the walking toy comprising:

a crank member rotatably supported in the torso and having a pair of crank eccentric shafts positioned eccentrically from a rotational axis of the crank member, wherein the crank eccentric shafts are arranged so as to have opposite phases from each other with respect to the rotational axis, each of the legs has a motion member giving rotational force to the crank member when the torso moves forward, each of the motion members has an eccentric shaft connecting parts pivotably connected to the corresponding crank eccentric shafts, a torso cooperation parts cooperating with the torso, and an action part on which force received from the walking surface act, support point mechanisms making the torso cooperation parts of the motion members function as points of support in the motion members are formed at the torso cooperation parts of the motion members and the torso, and if the torso is made to move forward to make the action part of the motion member of the one leg contacting the walking surface move rearward relative to the torso, the motion member of the one leg is pivoted using the upper part of that motion member as a point of support, and a rotational force is applied to the crank member by the motion member of the pivoting one leg and, the other leg is made to move forward in the state separated from the walking surface due to rotation of the crank member and then is made to contact the walking surface.

14. The walking toy according to claim 13, wherein the support point mechanisms include guide mechanisms guiding the torso cooperation parts of the motion members with respect to the torso.

15. The walking toy according to claim 14, wherein the guide mechanisms guide the torso cooperation parts with respect to the torso in a direction where the torso forms an angle with respect to the walking surface when the torso is in a state standing upright with respect to the walking surface.

16. The walking toy according to claim 14 wherein the guide mechanisms have grooves provided at one of the torso cooperation parts and the torso, and projections provided at the other of the torso cooperation parts and the torso, and the projections slide in the grooves whereby the torso cooperation parts are guided with respect to the torso.

17. A walking toy having: an upper body part including a torso: and two legs connected to the torso, in which if the torso is made to move forward in the state where a contact surface of at least one leg contacts a walking surface, walking motion is performed by the legs, the walking toy comprising:

a crank member rotatably supported in the torso and having a pair of crank eccentric shafts positioned eccentrically from a rotational axis of the crank member, wherein the crank eccentric shafts are arranged so as to have opposite phases from each other with respect to the rotational axis, each of the legs has a motion member giving rotational force to the crank member when the torso moves forward, each of the motion members has an eccentric shaft connecting part pivotably connected to the corresponding crank eccentric shafts, a torso cooperation parts cooperating with the torso, and an action part on which force received from the walking surface act, movement limiting mechanisms limiting the range by which the torso cooperation parts of the motion members can move with respect to the torso are formed at the torso cooperation parts of the motion members and the torso, and if the torso is made to move forward to make the action part of the motion member of the one leg contacting the walking surface move rearward relative to the torso, the motion member of the one leg moves to apply rotational force to the crank member by the motion member due to the range of possible movement of the torso cooperation part being limited by the movement limiting mechanism, and, the other leg is made to move forward in a state separated from the walking surface due to rotation of the crank member and then contacts the walking surface.

18. The walking toy according to claim 17, wherein the movement limiting mechanisms include guide mechanisms guiding the torso cooperation parts with respect to the torso.

19. The walking toy according to claim 18, wherein the guide mechanisms guide the torso cooperation parts with respect to the torso in a direction where the torso forms an angle with respect to the walking surface when the torso is in a state standing upright with respect to the walking surface.

20. The walking toy according to claim 18 wherein the guide mechanisms have grooves provided at one of the torso cooperation parts and the torso, and projections provided at the other of the torso cooperation parts and the torso, and the projections slide in the grooves whereby the torso cooperation parts are guided with respect to the torso.

* * * * *